US006595611B1

(12) United States Patent
Ruffino

(10) Patent No.: US 6,595,611 B1
(45) Date of Patent: Jul. 22, 2003

(54) INK EJECTION TRACKING FOR CONTROLLING PRINTHEAD NOZZLE MAINTENANCE

(75) Inventor: Charles A. Ruffino, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/262,460

(22) Filed: Oct. 1, 2002

(51) Int. Cl.[7] ..... B41J 29/38; B41J 2/165
(52) U.S. Cl. ..... 347/5; 347/23
(58) Field of Search ..... 347/5, 23

(56) References Cited

U.S. PATENT DOCUMENTS

| | | | |
|---|---|---|---|
| 4,571,599 | A | 2/1986 | Rezanka |
| 4,638,337 | A | 1/1987 | Torpey et al. |
| RE32,572 | E | 1/1988 | Hawkins et al. |
| 4,746,938 | A | 5/1988 | Yamamori et al. |
| 4,849,774 | A | 7/1989 | Endo et al. |
| 4,853,717 | A | 8/1989 | Harmon et al. |
| 4,855,764 | A | 8/1989 | Humbs et al. |
| 5,210,550 | A | 5/1993 | Fisher et al. |
| 5,300,968 | A | 4/1994 | Hawkins |
| 5,371,530 | A | 12/1994 | Hawkins et al. |
| 5,404,158 | A | 4/1995 | Carlotta et al. |
| 5,579,453 | A | 11/1996 | Lindenfelser et al. |
| 5,850,237 | A | 12/1998 | Slade |
| 6,130,684 | A | 10/2000 | Premnath et al. |
| 6,416,161 | B1 | 7/2002 | Berg et al. |

*Primary Examiner*—Judy Nguyen
*Assistant Examiner*—Michael S Brooke
(74) *Attorney, Agent, or Firm*—Fay, Sharpe, Fagan, Minnich & McKee, LLP

(57) ABSTRACT

An ink recorder and a method of tracking ink ejections from nozzles of a printhead in the ink recorder to bypass or reduce maintenance of the nozzles is provided. In one aspect, the ink recorder includes: a printhead with a plurality of ink ejecting nozzles arranged in a single column; a print controller with a first and a second raster buffer; a first and a second stroke buffer; a DMA channel; a print engine; and a maintenance controller. In another aspect, the method controls printhead nozzle maintenance during a print job in an ink recorder that prints an image using a plurality of color inks, wherein the single column of nozzles in the printhead includes a segment of active nozzles associated with each color ink and one or more inactive nozzles between each adjacent segment.

22 Claims, 15 Drawing Sheets

FIG. 2
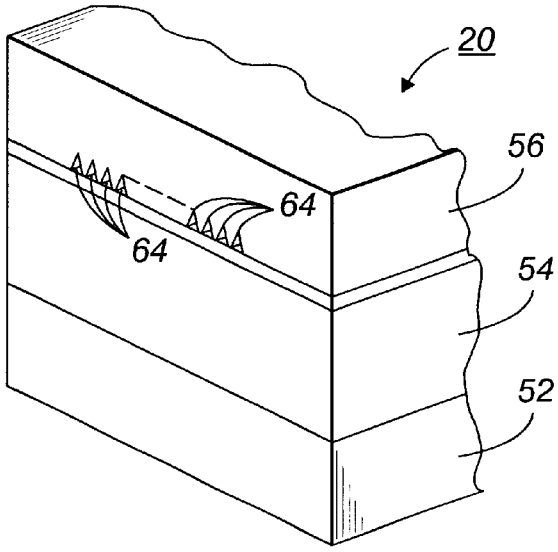
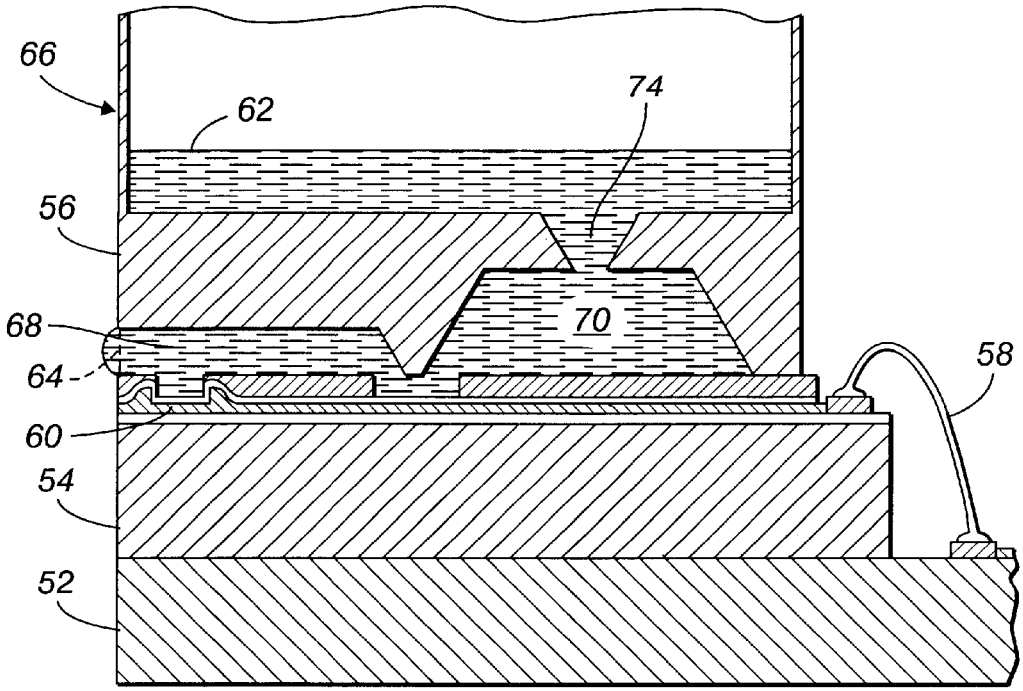
FIG. 3

INK EJECTION TRACKING FOR CONTROLLING PRINTHEAD NOZZLE MAINTENANCE

BACKGROUND OF INVENTION

The invention relates to tracking ink ejections from nozzles of a printhead in an ink recorder. It finds particular application in conjunction with controlling maintenance of nozzles of the printhead based on ink ejection tracking and will be described with particular reference thereto. However, it is to be appreciated that the invention is also amenable to other applications.

Ink recorders of the type frequently referred to as ink jet printers, acoustic ink printers, or liquid ink printers, have at least one printhead from which droplets of ink are directed to a recording medium. Common methods of directing the ink droplets include continuous jetting under pressure followed by electrostatic or magnetic control of the flight of the droplets; drop ejection on-demand by pressure pulse from a piezoelectric transducer, a thermally expanding liquid or solid member, focused acoustic energy, or an induced liquid-vapor transition; or, on-demand extraction of the ink from a nozzle or pool by electrostatic, magnetic or wetting forces. In the most prevalent drop-on-demand ink jet recorders, the ink may be contained in a plurality of channels within the printhead where pressure pulses that push ink out of the channels or extraction force pulses that pull ink out of the channels are used to selectively direct ink to the image receiving medium. In order to define small droplets of liquid so that high quality printing of an image may be done, the channels and, especially, the ink emitting ending nozzles of the channels, maybe narrow and have a cross-sectional area on the order of the cross-sectional area of the drops to be emitted.

In a thermal ink jet printer, pressure pulses are generated by rapidly heating ink in a small channel or chamber so that a component of the ink expansively vaporizes creating a pressure impulse that ejects ink from a nozzle in liquid communication with the channel or chamber. The ink heating pulses are usually produced by resistors located on an inner surface of the ink channels or chambers that are pulsed with sufficient electric voltage to vaporize an ink component in a portion of the ink adjacent the resistors, typically, water. Thermal ink jet printheads usually have a plurality of ink emitters and a corresponding plurality of ink heating resistors that are individually addressable by voltage pulses to heat and vaporize ink. Thus the emission of ink drops from the plurality of emitters can be electronically controlled by the timing of voltage pulses applied to the resistor heaters corresponding to each of the plurality of emitters. Following a short time duration voltage pulse to a heater, ink adjacent the heater vaporizes explosively, pushing ink out of a nozzle that is in close fluid communication with the channel or chamber where the vapor bubble has been generated. The vapor in the bubble quickly cools and transitions back to a liquid state. This transition causes the bubble to collapse to create partial vacuum pressure that pulls ink away from the emitting nozzle. This push-pull sequence causes a portion of the liquid at the nozzle to separate as a droplet and continue moving in a direction away from the nozzle and towards the recording medium. Capillary action of the ink in the narrow channels and constricted nozzle region draws ink from an ink supply reservoir thereby readying the thermal ink jet drop emitter for the next electronic command to print a drop. Operation of a thermal ink jet printer is described in, for example, U.S. Pat. No. 4,849,774.

A carriage-type thermal ink jet printer is described in U.S. Pat. No. 4,638,337. That printer has a plurality of printheads, each with its own ink tank cartridge, mounted on a reciprocating carriage. The channel nozzles in each printhead are aligned perpendicular to the line of movement of the carriage. A swath of information is printed on the stationary recording medium as the carriage is moved in one direction. The recording medium is then stepped, perpendicular to the line of carriage movement, by a distance equal to the width of the printed swath. The carriage is then moved in the reverse direction to print another swath of information.

It has been recognized that there is a need to maintain the nozzles and channels of a printhead in an ink recorder, for example, by capping the printhead when the printer is idle for extended periods of time. Capping the printhead is intended to prevent the ink in the printhead from drying out, which could prevent ink from being properly ejected from a nozzle. There is also a need to prime a printhead before use to ensure that the printhead channels are completely filled with ink and contain no contaminants or air bubbles, and to also periodically eject ink from the nozzles of an uncapped printhead to maintain proper ink characteristics and functioning of the drop ejection process. The periodic ejection of ink from the nozzles of an uncapped printhead, also known as ink purging, is done to counteract the effects of ink component evaporation at the ink-air surface located at the ink emitting nozzle. Especially in the case of thermal ink jet inks, some ink component is necessarily vaporizable and, therefore, somewhat volatile and subject to evaporation. Purging ink periodically from a nozzle subject to evaporation serves to eliminate ink whose properties have changed due to loss of a volatile component, thereby eliminating a potential source of poor ejection performance. Maintenance stations designed to maintain printheads of various types are described in, for example, U.S. Pat. Nos. 4,855,764; 4,853,717; and 4,746,938. Various methods and apparatus for maintaining the operation of printheads are also described in the following disclosures.

U.S. Pat. No. 5,404,158 to Carlotta et al. discloses a maintenance station for an ink jet printer having a printhead with nozzles in a nozzle face and an ink supply cartridge is mounted on a translatable carriage for concurrent movement therewith. When the printer is in a non-printing mode, the carriage is translated to the maintenance station located outside and to one side of a printing zone, where various maintenance functions are provided depending upon the location of the carriage mounted printhead within the maintenance station. The printhead nozzle face is cleaned by at least one wiper blade as the printhead enters and leaves the maintenance station. Adjacent the wiper blade is a location for collecting nozzle-clearing ink droplets, followed by a capping location where a carriage actuatable cap moves into sealing engagement with the printhead nozzle face and surrounds the nozzle to provide a controllable environment therefore. A vacuum pump is interconnected to the cap by flexible hose with an ink separator therebetween. Priming is conducted when continued movement of the carriage mounted printhead actuates a pinch valve to isolate the separator from the cap and enable a predetermined vacuum to be produced therein by energizing the vacuum pump. Once the carriage mounted printhead returns to the capping location, the pinch valve is opened subjecting the printhead to the separator vacuum and ink is drawn from the printhead nozzle to the separator. Movement of the carriage mounted printhead past the wiper blade uncaps the nozzle face to stop the prime, enable ink to be removed from the cap to the separator and cleans the nozzle. The vacuum pump is de-energized and the printhead is returned to the capping location to await the printing mode of the printer.

U.S. Pat. No. 5,850,237 to Slade discloses an apparatus and method for maintaining the proper operation of an ink recorder having an printhead that prints an image on a recording medium by selectively depositing ink drops from a plurality of ink nozzles in response to image data. The ink recorder supports a plurality of performance modes and may be a color image recorder having a plurality of color inks and a plurality of ink nozzles for each color ink. A time period during printing is determined and the number of print drop commands received by each of the plurality of ink nozzles is counted during the time period. A target value for the number of print drop commands received by each nozzle is set based on a pre-determined one of the plurality of performance modes, the image data, and a characteristic of each color ink in the case of a color ink recorder. If, during the time period determined, all of the nozzles receive the appropriate target number of print commands, then a purge ink procedure is not executed and printing is not interrupted. The print quality, overall printing speed, and ink waste are optimized by utilizing all of the factors cited in setting the target values for the number of print commands to be received by each ink nozzle in order to avoid unneeded purge ink procedures.

U.S. Pat. No. 6,130,684 to Premnath et al. discloses an ink jet printer with a capping and wiping system in a maintenance station that is connected to a common vacuum source. The wiping system includes a blotter-type collection member that presents an air vent when the printhead is in a capped position. When a priming operation is initiated, the air vent route is blocked, and full pressure is applied at the capping nozzle interface.

U.S. Pat. No. 6,416,161 B1 to Berg et al. discloses a method and system for a wiper blade mechanism usable in a maintenance station of an ink jet printer, including at least one printhead cap, a scraper, a cam shaft, a drive gear mechanism, at least one wiper blade, and a spittoon.

The disclosures cited above demonstrate that the need, devices and methods for periodically ejecting purge ink droplets from an ink recording printhead in order to maintain acceptable performance are recognized. However, periodic ink purging for maintenance purposes has the drawbacks of interrupting printing in certain circumstances, using valuable ink for non-printing purposes, and requiring provision for removal and storage of the purged ink. Therefore an ink recorder is needed that optimally balances the advantages to printhead maintenance of ink periodic purging with other important recorder performance attributes such as overall printing speed, minimum waste of printing ink, and minimum space and mechanism requirements to manage purged ink.

The appropriate frequency of ink purging is related to the properties of the ink compositions being used, many printhead parameters, environmental factors such as temperature and humidity, and the desired print quality. For a given set of ink, printhead and environmental parameter values, the frequency of ink purging can be decreased at the expense of more variation in drop ejection performance attributes such as drop velocity, direction and volume. Such variations, in turn, cause print quality imperfections arising from misplaced and incorrectly sized ink spots.

In color ink recorders, a plurality of inks are used, for example, black, cyan, magenta, and yellow inks. Each of these inks may have a different response to the frequency of ink purging. And, also, the overall affect on the quality of the color image may be different for different amounts of misplaced and incorrectly sized ink spots of the different individual color inks.

BRIEF SUMMARY OF INVENTION

Thus, there is a particular need for increasing the throughput of an ink recorder and conserving ink by reducing printhead maintenance activities during printing. The invention contemplates a method of ink ejection tracking for controlling printhead maintenance that overcomes at least one of the above-mentioned problems and others.

In one aspect of the invention, an ink recorder for receiving raster print data and printing an image on a recording medium corresponding to the raster print data received is provided. The ink recorder includes: a printhead with a plurality of ink ejecting nozzles arranged in a single column; a print controller with a first and a second raster buffer; a first and a second stroke buffer; a DMA channel interconnecting the raster buffers and the stroke buffers; a print engine in communication with the stroke buffers and the printhead; and a maintenance controller in communication with the DMA channel and the print controller, wherein the maintenance controller monitors the DMA channel for the print data blocks communicated from the raster buffers to the stroke buffers, and communicates maintenance bypass information to the print controller.

In another aspect of the invention, a method of ink ejection tracking for controlling printhead nozzle maintenance of a printhead in an ink recorder during a print job, wherein the printhead includes a plurality of ink ejecting nozzles arranged in a single column is provided. The method includes: a) receiving input print parameters and raster print data associated with an image to be printed; b) resetting a maintenance cycle timer and a nozzle ejection buffer; c) loading a first print swath of raster print data in a first raster buffer; d) generating and storing linked print data block parameters associated with the raster print data in the first raster buffer; e) loading a second print swath of raster print data in a second raster buffer; f) loading a first stroke buffer with a first print data block from the first raster buffer via a DMA channel; g) identifying nozzle ejection signals in the first print data block communicated via the DMA channel to generate nozzle ejection information; h) storing new and accumulated nozzle ejection information in the nozzle ejection buffer; i) updating a printhead maintenance bypass status based on the stored nozzle ejection information; j) repeating steps f)–i) until the last print data block in the first raster buffer is loaded in a stroke buffer, first using a second stroke buffer, then alternating between the first and second stroke buffers; k) if the print job is complete, performing a completion procedure, otherwise, repeating steps d)–j) until the maintenance cycle timer expires, first generating print data block parameters for the raster print data in the second raster buffer, then alternating between the first and second raster buffers; l) after the maintenance cycle timer expires, determining the condition of the printhead maintenance bypass status to check if printhead maintenance may be bypassed; and m) if printhead maintenance may be bypassed, resetting the maintenance cycle timer and the nozzle ejection buffer and repeating steps d)–l), otherwise, performing periodic printhead maintenance, resetting the maintenance cycle timer and the nozzle ejection buffer, and repeating steps d)–l).

In another aspect of the invention, a method of ink ejection tracking for controlling printhead nozzle maintenance of a printhead during a print job in an ink recorder that prints an image using a plurality of color inks, wherein the printhead includes a plurality of ink ejecting nozzles arranged in a single column, wherein the single column of nozzles in the printhead includes a segment of active nozzles associated with each color ink and one or more inactive nozzles between each adjacent segment is provided. The method includes: a) receiving input print parameters and raster print data associated with an image to be printed; b) resetting a maintenance cycle timer and a nozzle ejection buffer; c) loading a first print swath of raster print data in a first raster buffer associated with a first color ink and a third raster buffer associated with a second color ink; d) generating and storing linked print data block parameters associated with the raster print data in the first raster buffer and the third raster buffer; e) loading a second print swath of raster print data in a second raster buffer associated with the first color ink and a fourth raster buffer associated with the second color ink; f) loading a first stroke buffer with a first print data block from the first raster buffer and a first print data block from the third raster buffer via a DMA channel; g) identifying nozzle ejection signals in the first print data blocks communicated via the DMA channel to generate nozzle ejection information; h) storing new and accumulated nozzle ejection information in the nozzle ejection buffer; i) updating a printhead maintenance bypass status based on the stored nozzle ejection information; j) repeating steps f)–i) until the last print data blocks in the first and third raster buffers are loaded in a stroke buffer, first using a second stroke buffer, then alternating between the first and second stroke buffers; k) if the print job is complete, performing a completion procedure, otherwise, repeating steps d)–j) until the maintenance cycle timer expires, first generating print data block parameters for the raster print data in the second and fourth raster buffers, then alternating between the first/third raster buffers and the second/fourth raster buffers; l) after the maintenance cycle timer expires, determining the condition of the printhead maintenance bypass status to check if printhead maintenance may be bypassed; and m) if printhead maintenance may be bypassed, resetting the maintenance cycle timer and the nozzle ejection buffer and repeating steps d)–l), otherwise, performing periodic printhead maintenance, resetting the maintenance cycle timer and the nozzle ejection buffer, and repeating steps d)–l).

Benefits and advantages of the invention will become apparent to those of ordinary skill in the art upon reading and understanding the description of the invention provided herein.

BRIEF DESCRIPTION OF DRAWINGS

The invention is described in more detail in conjunction with a set of accompanying drawings.

FIG. 2 is a perspective view of a front face of an embodiment of a printhead showing a plurality of nozzles.

FIG. 3 is a cross-sectional view of one of a plurality of nozzles for an embodiment of a thermal ink jet printhead.

DETAILED DESCRIPTION

Figure 1:
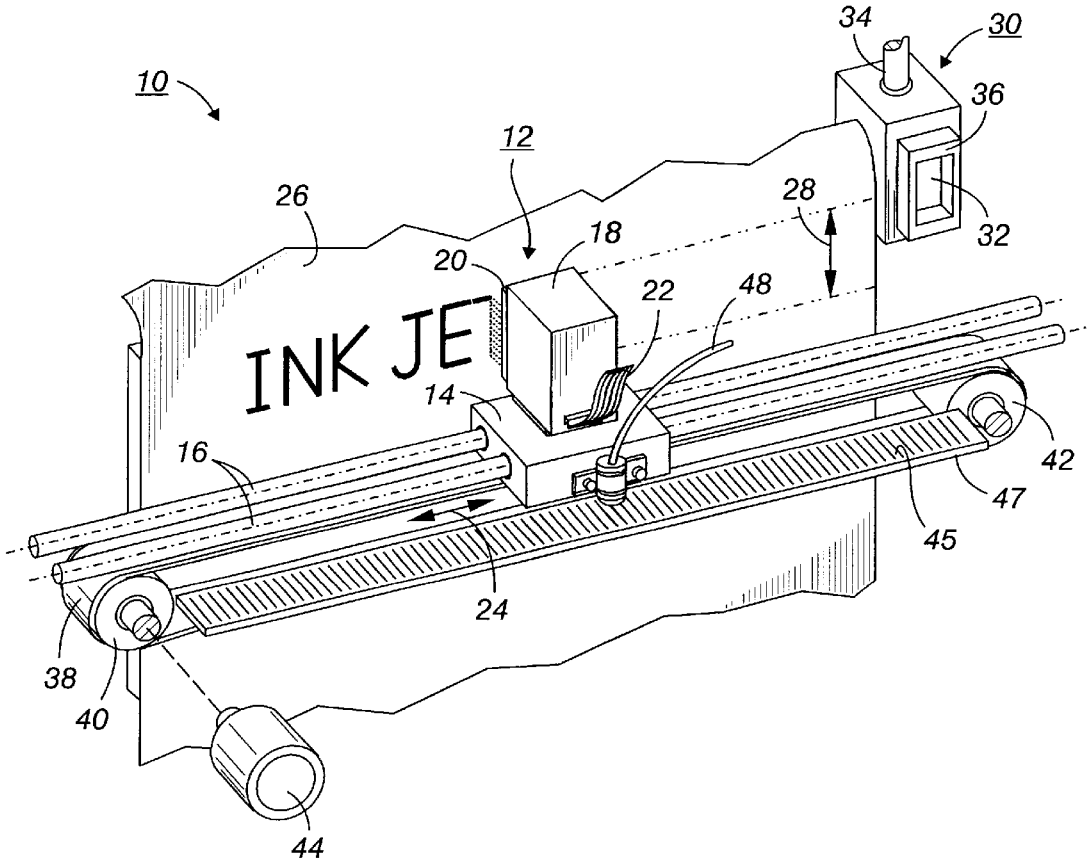
FIG. 1 is a partial perspective view of an embodiment of an ink recorder with a maintenance station and carriage-driven printhead.

While the invention is described in conjunction with the accompanying drawings, the drawings are for purposes of illustrating exemplary embodiments of the invention and are not to be construed as limiting the invention to such embodiments. It is understood that the invention may take form in various components and arrangement of components and in various steps and arrangement of steps beyond those provided in the drawings and associated description. Within the drawings, like reference numerals denote like elements and similar reference numerals (e.g., 100:200, 130:330) denote similar elements.

With reference to FIG. 1, a partial perspective view of an embodiment of an ink recorder 10 with a maintenance station and a carriage-driven printhead is provided. The ink recorder 10 includes a print cartridge 12, a carriage 14, and carriage rails 16. The printhead cartridge 12 includes a housing 18 containing ink for supply to a printhead 20 that expels drops of ink under control of electrical signals received from a controller (not shown) through an electrical cable 22. The printhead 20 contains a plurality of ink channels (not shown) that carry ink from the housing 18 to respective nozzles (also not shown). When printing, the carriage 14 reciprocates or scans back and forth along the carriage rails 16 in the direction of an arrow 24 (i.e., carriage direction). The nozzles are typically arranged in a single-column array extended perpendicular to the carriage direction 24. As the printhead cartridge 12 reciprocates back and forth across a recording medium 26, such as a sheet of paper or a transparency, drops of ink are ejected from selected nozzles towards the sheet of recording medium 26 to form an image comprising ink dot patterns during a plurality of vertical strokes over a plurality of swaths across the recording medium 26. Individual nozzles print individual dots of the image during the plurality of strokes, as the printhead 20 moves across the recording medium 26. During each pass of the carriage 14, the recording medium 26 is held in a stationary position. At the end of each pass, however, the recording medium is stepped in the direction of an arrow 28 (i.e., line feed direction). For a more detailed explanation of the printhead and printing, reference is made to U.S. Pat. No. 4,571,599 and U.S. Pat. No. Re. 32,572.

At one side of the ink recorder 10, outside a printing zone, which encompasses the width of the recording medium 26, is a maintenance station 30, a portion of which is illustrated. At the end of a print job, or at intermediate times when necessary, the carriage 14 is moved to a maintenance position confronting the maintenance station 30 which includes a chamber 32 to which a suction device is connected and through which a vacuum is applied through a vacuum line 34. The chamber 32 includes an opening having attached thereto a maintenance/priming element 36 that contacts the opposing face of the printhead cartridge 12 and forms a seal around the nozzles 64 (FIG. 2) of the printhead 20 when the carriage is located at the maintenance station position. During a priming operation, a vacuum pump (not shown) applies vacuum to the vacuum line 34 through a waste tank (not shown) for removing ink or debris to ensure proper operation of the nozzles of the printhead cartridge 12. The maintenance/priming element 36, when in contact with the printhead cartridge, maintains an airtight seal around the nozzles.

The chamber 32 is also used as a purge ink receiver to receive non-printing ink ejected from the printhead during a purging maintenance procedure. Alternately, the maintenance station 30 may have a separate open receptacle for receiving non-printing ink ejected during a purging maintenance procedure that is not brought into sealable contact with the printhead. The purge ink receiver may also be located at a different position along the carriage motion, for example at the other side of the recording medium, rather than the side of the main maintenance station 30. Further, more than one purge ink receiver may be employed to reduce the amount of time used in printhead 20 travel when a purge ink procedure is executed during an image recording task. U.S. Pat. No. 5,210,550 describes a maintenance station for ink jet printers in more detail.

Figure 4:
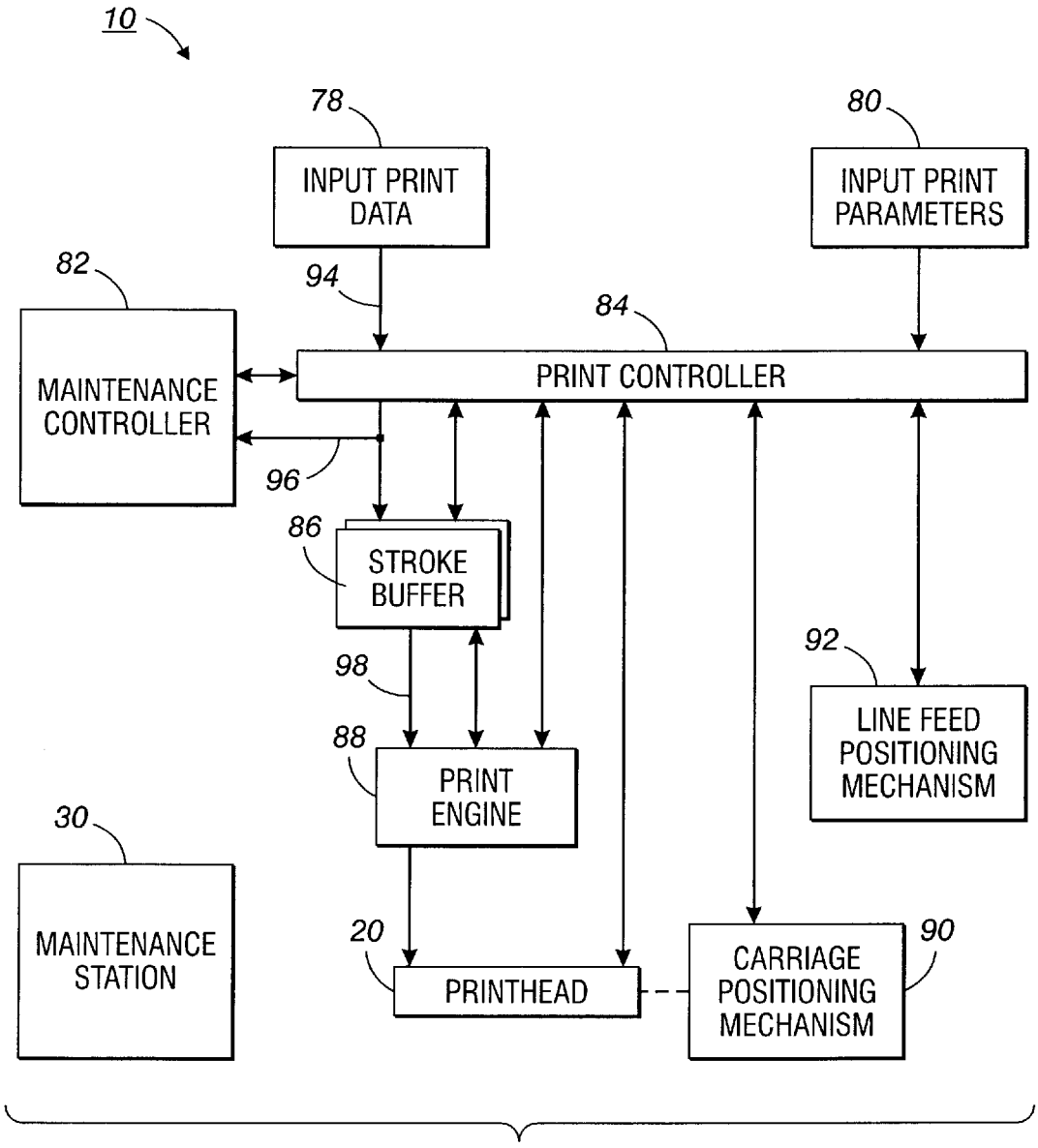
FIG. 4 is a block diagram of an embodiment of an ink recorder.

The carriage 14 is moved back and forth in the carriage direction 24 by a belt 38. The belt 38 is driven by a first rotatable pulley 40 and a second rotatable pulley 42. The first rotatable pulley 40 is in turn, driven by a reversible motor 44 under control of a print controller. In addition to the toothed-belt/pulley system for causing the carriage to move, it is also possible to control the motion of the carriage by using a cable/capstan, lead screw, or other mechanisms as known by those skilled in the art. To control the movement and position of the carriage 14 along the carriage rail 16, there is included a linear strip 47 encoded with a pattern 46 of photographically or mechanically reproduced fiducial marks. The pattern 46 is sensed by a sensor 48, such as a photodiode, attached to the carriage 14. The linear strip 47 extends into an area outside the width of the recording medium 26 such that carriage control to a position in front of the maintenance station 30 can by accomplished when necessary. Other positioning devices such as rotary encoders, stepper motors or other known techniques are also possible. The carriage 14, belt 38, rotatable pulleys 40 and 42, reversible motor 44, carriage rails 16, linear strip 47, and sensor 48 constitute a carriage positioning mechanism 90 (FIG. 4).

At the completion of a print job and at other appropriate times during a print job, the printhead cartridge 12 is moved to a position outside the printing zone to engage the maintenance station 30. When the printhead cartridge 12 is aligned therewith, the maintenance station 30 is moved towards the printhead cartridge 12 until the maintenance/priming element 36 contacts the printhead cartridge 12. The printhead cartridge 12 usually ejects ink from all of the nozzles of the printhead 20 to thereby purge the nozzles and to force any ink from the nozzles that may have dried sufficiently to impede the proper ejection of ink therefrom. Typically, ink is ejected from every nozzle after a fixed printing interval into the maintenance station. These purging drops remove the viscous plug that forms at the nozzle-to-air interface due to the evaporation of the volatile components of the ink. Printhead maintenance may be bypassed during a particular printing interval in which all of the nozzles have ejected ink droplets. In another embodiment, printhead maintenance may be reduced during a particular printing interval in which some of the nozzles have ejected ink droplets. In the embodiment being described, printhead maintenance for the nozzles that have ejected ink droplets may be bypassed or printhead maintenance for the nozzles of a printhead segment for a particular type of ink in which all of the nozzles have ejected ink droplets may be bypassed.

In still another embodiment, printhead maintenance may be bypassed during a particular printing interval in which all of the nozzles have ejected a predetermined number of ink droplets. In one known printer, it has been found that for every 45 seconds of the nozzles being exposed to air, 25 drops of ink per nozzle are required to be ejected to protect from soft printing defects such as clogged nozzles that cause missing scan lines of image or partially clogged nozzles that cause misplaced scan lines and dots and improperly sized dots. While this ink purging only wastes a small amount of ink, it includes the movement of the printhead cartridge to the maintenance station located off the printed page, therefore resulting in a decrease in print speed, that is, an overall recording throughput reduction. Depending on the ink formulation and the nozzle design, the requirements for purging differ. Such ink purging without taking into account whether or not a nozzle has ejected ink, results in inefficient maintenance of the nozzles.

In color ink recorders of the scanning carriage type illustrated in FIG. 1, the printhead will have inks of a plurality of colors and separate ink nozzles associated with each color ink. The nozzles for different color inks may be in segments of the same printhead with segmented ink supply pathways for each color ink or the printhead may be an assembly of printhead subunits in which different color inks supply the ink nozzles of a corresponding subunit. Or in some known ink jet systems, the printhead is an assembly of both types, for example a first subunit for black ink with black ink nozzles and a second subunit that is further segmented for cyan, magenta, and yellow inks with corresponding nozzles. Whatever the detailed organization of the printhead, the fact that ink nozzles of different colors are carried by a common carriage 14 (in FIG. 1), means that performing an ink purging procedure on the nozzles of one color includes the interruption of printing of the nozzles of all of the colors of ink. Because of variations of the chemical properties of colorant materials and the possibility of differing print quality requirements for the different color separations of the image, it is likely that the nozzles for some color inks will require different ink purge conditions than those of other colors. Invoking ink purging without taking into account whether or not a nozzle has ejected ink, and without adjusting purging criteria based on the properties of the different inks in a multi-color recorder results in inefficient operation of the color image recorder.

In view of these problems, the present invention includes an apparatus and a method for presetting the criterion for periodic ink purging based on certain characteristics of the ink to be purged. In the case of a color ink recorder the criteria for periodic purging may be different for each color of ink and resulting purging may be performed on different cycles. The apparatus and method then determine for each period of the periodic ink purging cycle whether any of the ink nozzles within a printhead require ink purge maintenance. If any nozzles require purging, an ink purge procedure is executed. However, if none of the nozzles need ink purging, the ink purge procedure for that cycle is eliminated. Controlling printhead maintenance based on the image data and the properties of each of the color inks in a multi-color recorder, not only increases the throughput in scanning type ink jet printers, but also reduces the amount of wasted ink. In fact, in the case of scanning type printhead carriages having partial width array printheads, the increase in throughput can be significant, particularly when printing pictures or photos, since typically all of the nozzles in a partial width array printhead eject ink sufficiently often to make many ink purge maintenance operations unnecessary.

As described above, in an alternate embodiment, using intelligent printhead maintenance, maintenance may be reduced during a particular printing interval in which some of the nozzles have ejected a predetermined amount of ink droplets. In this alternate embodiment, printhead maintenance for the nozzles that have ejected a predetermined amount of ink droplets may be bypassed or printhead maintenance for the nozzles of a printhead segment for a particular type or color of ink in which all of the nozzles have ejected a predetermined amount of ink droplets may be bypassed.

With reference to FIG. 2, a perspective view of a front face of an embodiment of a printhead 20 showing a plurality of nozzles 64 is provided. The printhead 20 is constructed from several layers. A channel and ink reservoir layer 56 has fine, closely spaced grooves that serve as ink channels for individual nozzles as well as larger depressions and through-layer holes that serve as ink supply reservoirs and ink inlets. A heater layer 54 is fabricated by microelectronic methods and has a plurality of heating resistors, at least one heater resistor for each ink nozzle channel, and resistor interconnection circuitry so that each heater resistor can be individually addressed and controlled to eject ink drops. Layer 52 is a heat sink provided to both support the other layers of the device and to store and conduct heat away from the heater resistor portion of the device enabling rapid repetition of drop ejection.

With reference to FIG. 3, a cross-sectional view of one of a plurality of nozzles 64 for an embodiment of a thermal ink jet printhead is provided. In this cross-sectional view some features of the channel and ink reservoir layer 56 and the heater layer 54 can be seen. Also a portion of the wall 66 of the housing 18 (FIG. 1) can be seen attached to the upper surface of the channel and ink reservoir layer 56. Ink 62 enters through hole 74 into a local ink supply reservoir 70 and then can move into ink channel 68 ending at ejection nozzle 64. Heater resistor 60 is adjacent a portion of the ink near the end of ink channel 68. When heater resistor 60 is energized by a voltage pulse, the ink immediately adjacent the resistor in channel 68 is heated sufficiently for an ink component to vaporize creating a pressure pulse that ejects ink from nozzle 64.

There are many approaches known for applying a voltage pulse to a heater resistor 60. In the simplest printheads, an external lead such as wire bond 58 is provided for one terminal of each heater resistor and a common current return lead is provided for the other terminal. An external pulsing circuit provides the appropriate voltage pulses to the appropriate nozzle resistors based on the image data via the individual nozzle resistor leads. In a preferred embodiment, the heater layer 54 is an integrated circuit that includes, in addition to the heater resistors, a power MOS FET coupled to each resistor and addressing and drop ejection control circuitry for selecting and energizing the power MOS FET/resistor corresponding to the ink nozzle from which ink ejection is required by the image data. Such a printhead is described in U.S. Pat. Nos. 5,300,968 and 5,371,530.

With reference to FIG. 4, a block diagram of an embodiment of an ink recorder 10 is provided. The ink recorder 10 receives input print data 78 and input print parameters 80 from an external source for each print job. In this embodiment the ink recorder 10 includes a maintenance controller 82, a print controller 84, two stroke buffers 86, a print engine 88, a printhead 20, a carriage positioning mechanism 90, a maintenance station 30, and a line feed positioning mechanism 92. In alternate embodiments, additional stroke buffers may be incorporated. It is understood that the ink recorder 10 may also include other components not shown in this block diagram. For example, control circuitry and vacuum motors associated with the maintenance station, typically included in this type of ink recorder 10 , are not shown. It is also understood that, although the maintenance controller 82 is shown as a separate component, the functions performed by the maintenance controller may alternatively be carried out by the print controller 84 as a sub-function of overall device control.

The input print data 78 communicates raster print data 94 to the print controller 84. Typically, the raster print data 94 is in horizontal form (i.e., multiple rows of horizontal print data) and embedded in a standard page description language (PDL) (e.g., Printer Control Language (PCL). PostScript, etc.). The input print data 78 may be provided by any number of devices generating raster print data, including a personal computer or a scanner such as that found in a facsimile machine.

The input print parameters 80 communicate print instructions associated with the raster print data 78 to the print controller 84. The input print parameters 80 may be originated by a number of common hardware or software subsystems, for example, an interactive hardware panel associated with a companion facsimile machine, a user interface associated with software in a companion personal computer or facsimile machine, or a default value or condition established in the software. The input print parameters 80 may be communicated in the PDL along with the raster print data, in separate instructions or control signals, or in various combinations thereof. The input print parameters 80 may include, for example, certain performance modes that determine black or color printing, print quality, overall printing speed, and recording medium type. The print controller 84 uses the input print parameters 80, in combination with device parameters 8406 (FIG. 6) to determine, for example, which ink will be used for printing, the resolution, and whether a multi-pass mode will be used.

The print controller 84 controls the operation of the overall device by communicating with the stroke buffers 86, print engine 88, printhead 20, carriage positioning mechanism 90, line feed positioning mechanism 92, and maintenance controller 82. The print controller 84, in combination with the stroke buffers 86, converts the raster print data 94 into vertical print data 98 that is compatible with the single-column array of nozzles in the printhead 20 of the particular printhead cartridge 12 installed in the ink recorder 10. Generally, horizontal segments of the raster print data 94 are loaded in the stroke buffers 86 via the DMA channel 96 and sequential columns of vertical print data 98 are communicated from the stroke buffers 86 to the print engine 88. The print controller 84, in combination with the print engine 88, provides a column print data stream to the printhead 20.

Figure 5:
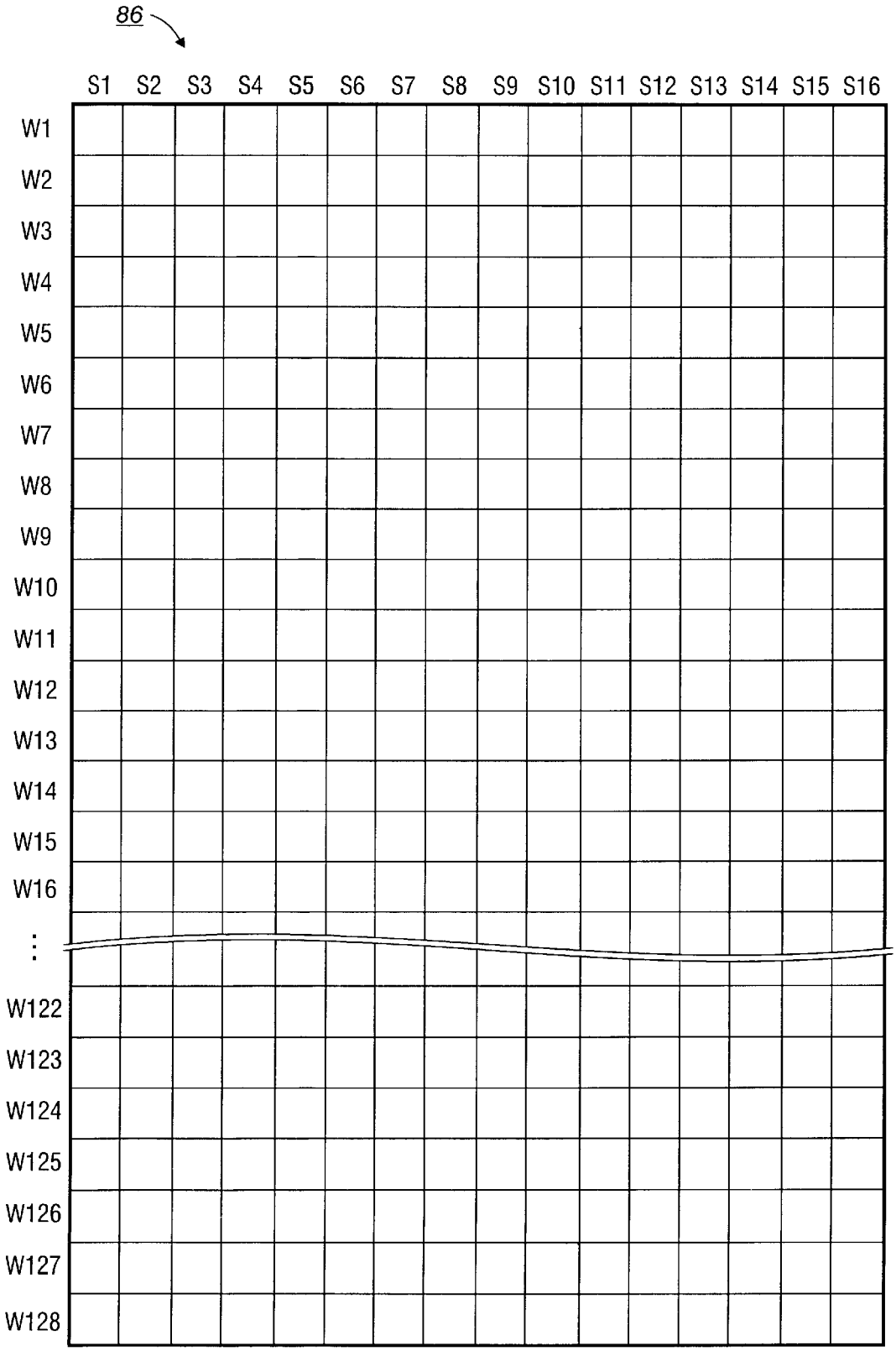
FIG. 5 is a diagram of storage locations in an embodiment of a stroke buffer.

With reference to FIG. 5, a diagram of storage locations in an embodiment of a stroke buffer 86 is provided. The stroke buffer 86 stores multiple words of print data (e.g., W1–W128). The print data words are represented in horizontal rows and each word relates to an individual nozzle in the printhead 20. The vertical arrangement of the multiple words in the stroke buffer 86 provides a direct correlation to the nozzles in the printhead 20. An exemplary embodiment of a stroke buffer 86 for a 128-nozzle printhead includes at least 128 words for storing print data. However, the word capacity of the stroke buffer 86 can exceed the number of nozzles in the printhead 20 of the particular print cartridge 12 installed. Therefore, one may size the stroke buffer 86 for a printhead 20 with the most nozzles that is contemplated for the ink recorder 10.

The horizontal arrangement of each word provides a direct correlation to a segment of the raster print data 94. The print data words (W1–W128) in the stroke buffer 86 are comprised of multiple bits of print data. For example, in the embodiment shown in FIG. 5 the stroke buffer 86 is comprised of 16-bit words. This relates to a 16-bit segment of horizontal print data that is related to the raster print data 94 from the input print data 78. Larger words (e.g., 32-bit) or smaller words (e.g., 8-bit) are also contemplated for stroke buffers 86. Therefore, the maximum size of horizontal segments varies depending on the actual implementation.

Referring again to FIG. 4, printing is performed by sequentially making vertical or columnar passes through the single-column array of nozzles in the printhead 20 as the printhead 20 is moved horizontally across the recording medium 26 (FIG. 1) by the carriage positioning mechanism 90. Each pass through the single-column array of nozzles in the printhead 20 is referred to as a stroke. Each pass across the recording medium is referred to as a swath. When a swath is completed, the line feed positioning mechanism 92 advances the recording medium. The distance that the recording medium is advanced is typically based on the vertical dimension of the swath and whether a multi-pass mode is being used. After the recording medium is advanced to the proper position, the printhead 20 is ready to print the next swath in another pass across the recording medium. Consecutive swaths are typically printed in opposite directions. The print controller 84 communicates the carriage direction of the current swath to the stroke buffers 86 and print engine 88 to ensure that the vertical print data 98 is communicated in the proper sequence for the direction in which the printhead 20 will be traversing the recording medium when the data is printed.

The print data in the stroke buffer 86 for a stroke is stored in a particular bit position (e.g., S1–S16) of the print data words (e.g., W1–W 128). In other words, each stroke is represented by a column of print data bits (e.g., S1, W1–S1, W128). For example, a stroke buffer 86 with 128 sixteen-bit words stores 16 strokes of print data and is compatible with printheads having up to 128 nozzles.

The print controller 84 uses the two stroke buffers 86 in a ping-pong or alternating fashion. First the print controller loads horizontal segments of raster print data 94 in a first stroke buffer 86 via the DMA channel 96. Next, the print controller 84, in conjunction with the first stroke buffer 86, sequentially communicates strokes of vertical print data 98 to the print engine 88 until all the strokes have been communicated. While the first stroke buffer 86 is being used in such fashion, the print controller 84 loads horizontal segments of raster print data 94 in a second stroke buffer 86. After all the strokes from the first stroke buffer are communicated to the print engine 88, strokes from the second stroke buffer 86 are communicated to the print engine 88 in the same fashion. The print controller 84 continues converting the raster print data 94 to vertical print data 98 and communicating strokes to the print engine 88 by alternating between the first and second stroke buffers 86 until a print swath is complete. This process is restarted when the ink recorder 10 is ready to print a next swath. In an alternate embodiment with more than two stroke buffers, the process sequences through the loading-converting-communicating steps for each of the stroke buffers in a staggered circular manner.

In one embodiment, the printhead 20 is an integrated circuit that includes, in addition to the heater resistors 60 (FIG. 3), a power MOS FET coupled to each resistor and addressing and drop ejection control circuitry for selecting and energizing the power MOS FET/resistor corresponding to the ink nozzle from which ink ejection is required by the image data. Such a printhead is described in U.S. Pat. Nos. 5,300,968 and 5,371,530.

Figure 8:
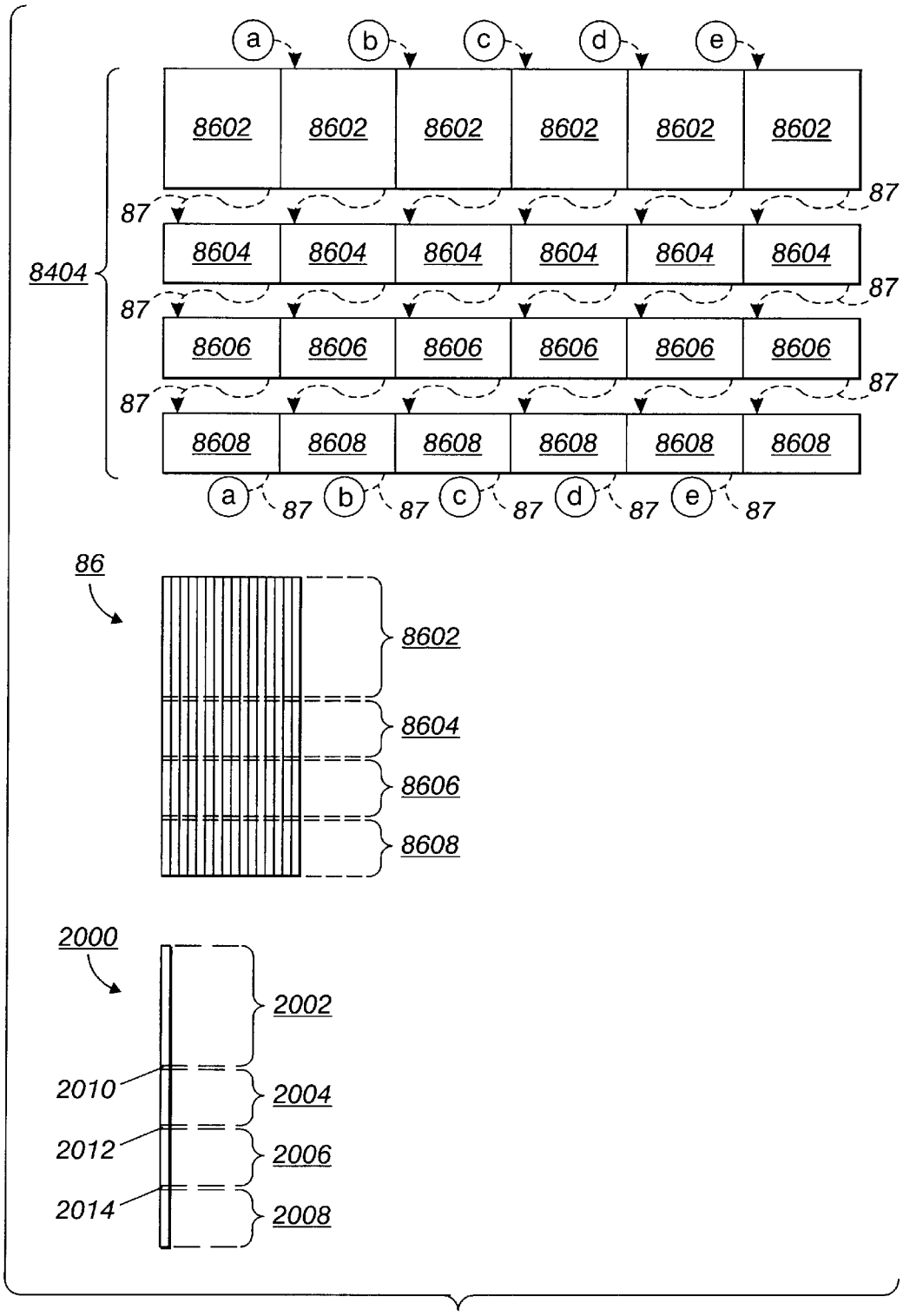
FIG. 8 is a diagram showing the relationship between linked PDBs in raster buffers, multiple columns of print data stored in stroke buffers, and a single-column array of nozzles in a CMYK printhead in an embodiment of an ink recorder.

In the case of a black printhead, each nozzle on the printhead is active and prints black ink. However, in the case of a color printhead, the printhead is segmented into blocks of nozzles, each block for printing a different color ink. Additionally, there are inactive nozzles between the nozzle segments to guard against intercolor bleeding at the color boundaries. An example of segmentation in a CMYK color printhead 2000 is shown in FIG. 8. The CMYK color printhead 2000 includes four segments (2002, 2004, 2006, 2008) with active nozzles with three groups of inactive nozzles (2010, 2012, 2014) between the segments. If, for example, the CMYK color printhead includes 128-nozzle printhead, the four segments could be identified as a 48-nozzle segment 2002 for printing black ink, a first 24-nozzle segment 2004 for printing cyan ink, a second 24-nozzle segment 2006 for printing magenta ink, and a 24-nozzle segment 2008 for printing yellow ink. Furthermore, for example, the three groups of inactive nozzles could be identified as a 4-inactive nozzle group 2010 between the black and cyan segments, a first 2-inactive nozzle group between the cyan and magenta segments, and a second 2-inactive nozzle group between the magenta and yellow segments.

Any inactive nozzles in a printhead must never be directed to eject ink, since doing so repetitively would destroy the printhead because there is no efficient means of removing the heat generated in the vicinity of the unused nozzle. Therefore, the algorithm used by the print controller 84 to load print data in the stroke buffers 86 must ensure that the each word corresponding to any inactive and unusable nozzle never contains print data directing that nozzle to eject ink.

For printhead maintenance, the print controller 84 communicates certain parameters associated with the print job and the device to the maintenance controller 82. The parameters, for example, include multi-pass printing modes, printhead segmentation, periodic maintenance cycle time, and quantity of ink ejections per nozzle during the maintenance cycle. The maintenance controller 82 controls the printhead maintenance functions of the ink recorder 10. The maintenance functions involve determining when printhead maintenance is required and when maintenance may be bypassed or reduced. The maintenance controller 82 monitors the print data carried over the DMA channel 96 and determines whether a particular cycle of periodic printhead maintenance may be bypassed. In other embodiments, when printhead maintenance is required, the maintenance controller 82 also determines whether maintenance during that particular periodic maintenance cycle may be reduced. In these embodiments, printhead maintenance may be reduced by bypassing certain segments of nozzles or individual nozzles in the printhead 20.

When printhead maintenance is performed, the print controller 84 suspends the processing of print data associated with the print job, positions the printhead 20 in relation to the maintenance station 30, processes maintenance print data through the stroke buffers 86 and print engine 88 as described above to provide purge drop ejection pulse sequences to the printhead, and operates a vacuum source (not shown) for priming the printhead 20 and removing purged ink from the maintenance station.

In addition to the various embodiments of an ink recorder described herein, the ink recorder may be adapted to operate in an electrophotographic printing system.

Figure 6:
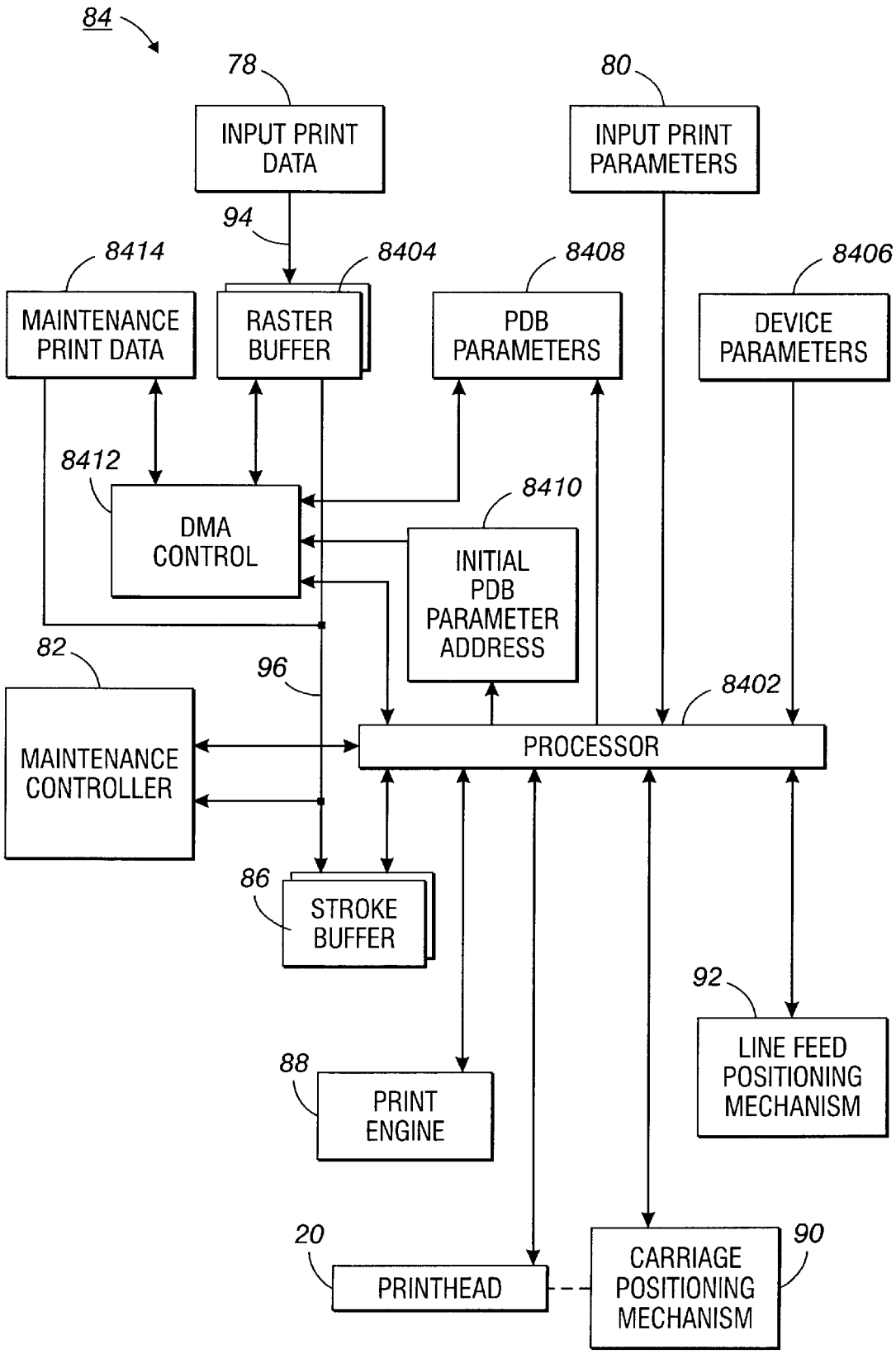
FIG. 6 is a block diagram of an embodiment of a print controller such as the one in FIG. 4.

With reference to FIG. 6, a block diagram of an embodiment of a print controller 84 such as the one in FIG. 4 is provided. The print controller 84 includes a processor 8402, two raster buffers 8404, device parameters 8406, print data block (PDB) parameters 8408, an initial PDB parameter address 8410, a DMA control 8412, and maintenance print data 8414. Interfaces between the components of the print controller 84 and input print data 78, input print parameters 80, stroke buffers 86, print engine 88, printhead 20, carriage positioning mechanism 90, line feed positioning mechanism 92, and maintenance controller 82 are also shown for clarity. In alternate embodiments additional raster buffers may be incorporated. In particular, for color printing, the print controller 84 includes at least two raster buffers for each color separation. It is understood that the print controller 84 may include other components not shown in the block diagram. For example, an operating program for controlling the overall device and an electronic clock for various timing functions. Moreover, the print controller 84 typically communicates over a bus with the various printer components and includes random access memory (RAM) and read only memory (ROM). While RAM and ROM components are not shown in FIG. 6, the raster buffers 8404, device parameters 8406, PDB parameters 8408, initial PDB parameter address 8410, and maintenance print data 8414 store information and may be allocated portions of RAM or ROM, whichever is suitable. Any of these components may alternatively be implemented in storage registers where suitable.

The processor 8402 in the print controller 84 controls the overall device by communicating with the device parameters 8406, PDB parameters 8408, initial PDB parameter address 8410, DMA control 8412, stroke buffers 86, print engine 88, printhead 20, carriage positioning mechanism 90, line feed positioning mechanism 92, and maintenance controller 82. The processor 8402, in combination with the DMA control 8412, initial PDB parameter address 8410, PDB parameters 8408, raster buffers 8404, and stroke buffers 86, converts the raster print data 94 into vertical print data 98 that is compatible with the single-column array of nozzles in the printhead 20 of the particular printhead cartridge 12 installed in the ink recorder 10. The processor 8402, in combination with the print engine 88, provides a column print data stream to the printhead 20.

Generally, multiple rows of raster print data 94 are loaded into the raster buffers 8404, the multiple rows of horizontal print data in the raster buffers 8404 are divided horizontally into rectangular segments or print data blocks (PDBs), the PDBs are loaded into the stroke buffers 86 according to linking information contained in the PDB parameters 8406, multiple columns of vertical print data 98 are sequentially communicated from the stroke buffers 86 to the print engine 88, and the column print data stream is communicated from the print engine 88 to the printhead 20.

The multiple horizontal rows of print data loaded in a raster buffers 8404 represents print data that is to be printed during one swath of the printhead 20 across the recording medium. The two raster buffers 8404 permit alternating and circular loading of raster print data 94 into a raster buffer 8404 while PDBs are being identified in another raster buffer 8404 and communicated to the stroke buffers 86.

Figure 7:
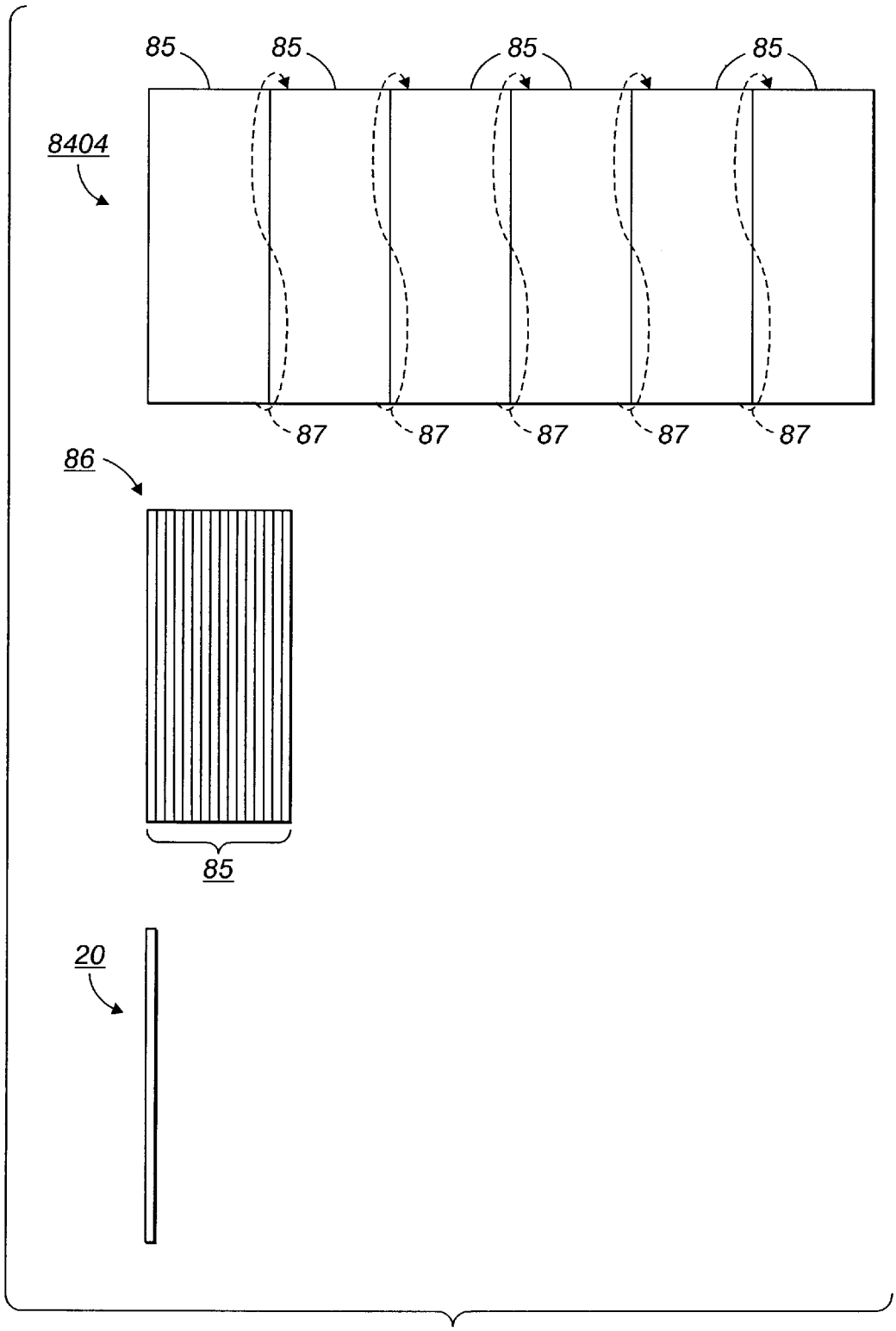
FIG. 7 is a diagram showing the relationship between linked print data blocks (PDBs) in raster buffers, multiple columns of print data stored in stroke buffers, and a single-column array of nozzles in a black printhead in an embodiment of an ink recorder.

With reference to FIG. 7, a diagram showing the relationship between linked PDBs in raster buffers 8404, multiple columns of print data stored in stroke buffers 86, and a single-column array of nozzles in a black printhead 20 in an exemplary embodiment of an ink recorder is provided. This relationship forms the basis by which DMA control 8412 simplifies both the conversion of raster print data 94 to a column print data stream and the tracking of ink ejections from the nozzles of the printhead 20. As described above, the printhead 20 is comprised of a single-column array of nozzles and the stroke buffer 86 is comprised of a plurality of words represented in a vertical column. Each word in the stroke buffer is associated with an individual nozzle of the printhead 20 and includes multiple bits that are represented horizontally. For the black printhead 20, segmentation of the printhead is not required. Therefore, the stroke buffer 86 is comprised of one PDB 85. The PDB 85 is defined vertically by the plurality of rows related to the single-column array of nozzles in the printhead 20 and horizontally by the plurality of columns related to the multiple bits in the words of the stroke buffer 86.

As described above, the raster buffer 8404 is comprised of multiple rows of horizontal print data that is to be printed during a swath of the printhead 20 across the recording medium. The raster buffer 8404 is defined vertically by the PDB and horizontally by the length of the swath of print data to be printed. Since the embodiment being described prints one color (i.e., black), the stroke buffer 86 is loaded by one PDB from one raster buffer 8404. Hence the vertical dimension of the raster buffer 8404 relates to the vertical dimension of the stroke buffer 86. As shown, the raster buffer 8404 is comprised of six PDBs, although for a minimal length print swath a raster buffer 8404 could be limited to one PDB. The rows of horizontal print data in the raster buffer are contiguous and represented as running from left to right. Therefore, the PDBs 85 are linked 87 in a contiguous manner and also represented in a sequence from left to right. The left-most PDB 85 is the initial PDB and the right-most PDB is the last PDB associated with the swath of print data to be printed. The links 87 between the PDBs define the sequence in which the PDBs will be printed. However, when printing is performed in both directions the device parameters indicating print direction will determine whether printing actually begins with the left-most PDB or the right-most PDB. Likewise, transfers from the raster buffer 8404 to the stroke buffer 86 will begin from either the left or right, depending on the direction in which the printhead 20 is printing.

Returning to FIG. 6, the device parameters 8406 communicate information associated with the configuration and capabilities of the device to the processor 8402. The device parameters 8406 may be read from ROM, RAM, or various sensors within the device. The device parameters 8406 may include, for example, information related to printhead detection, printhead identity, ink level, print resolutions, multi-pass print modes, carriage direction, printhead segmentation and inactive nozzle positions, printhead maintenance cycle times, and quantities of ink ejections required during the maintenance cycle to bypass maintenance. Many device parameters 8406 may have multiple values that depend on the input print parameters 80 or the particular printhead cartridge 12 installed in the ink recorder 10. For example, different selections for print quality and printing speed in the input print parameters 80 may determine which print resolution and multi-pass mode applies for a given print job. Similarly, where monochrome, color, or photo printhead cartridges 12 may be installed and where monochrome, color, or photo printing may be included in the input print parameters 80, any or all of the exemplary device parameters may vary depending on the configuration or selection for a given print job.

When the print controller 84 receives raster print data and print instructions for a print job, multiple horizontal rows of raster print data associated with a first print swath are loaded in a first raster print buffer 8404. The processor 8402 reads the device parameters 8406 and, in combination with the print instructions, determines how the first raster buffer 8404 is divided into PDBs 85. Then, the processor 8402 generates PDB parameters 8408 that define the size of the PDBs, linking information, and further instructions associated with loading the PDBs in the stroke buffers 86 via the DMA channel. A PDB parameter 8404, for example, may include the following information: i) the raster buffer address where the PDB begins, ii) information identifying the horizontal and vertical dimensions of the PDB, iii) identification of inactive nozzles in the printhead between nozzles printing this PDB and those printing the next PDB, iv) information associated with print data filtration for printing in a multi-pass mode, and v) a link to the next PDB parameter.

After the PDB parameters 8402 are stored, the processor 8402 stores the initial PDB parameter address 8410 and communicates with the DMA control 8412 to begin loading PDBs 85 from the first raster buffer 8404 into the stroke buffers 86. The DMA control 8412 reads the initial PDB parameter address 8410, accesses a first PDB parameter 8408, and begins loading a first PDB 85 from the first raster buffer 8404 into a first stroke buffer 86. The DMA control 8412 uses the linking information in the first PDB parameter 8408 to access a second PDB parameter 8408 and begins loading a second PDB 85 from the first raster buffer 8404 into a second stroke buffer 86. The DMA control 8412 continues this process alternating between the stroke buffers 86 for consecutive PDBs until the last PDB in the raster buffer is loaded. Presumably, column print data 98 is being communicated from one stroke buffer 86 to the print engine 88 while the other stroke buffer is being loaded. However, this is typically confirmed before the DMA control 8412 loads a stroke buffer 86 to ensure that print data that has not been communicated to the print engine 88 is not overwritten.

When all the PDBs 85 for the first print swath in the first raster buffer 8404 have been loaded in the stroke buffers 86, the process is restarted for a second print swath and a second raster buffer 8404. This process continues, alternating between raster buffers 8404 for consecutive print swaths until the print job is complete. However, during a print job, the print job may be interrupted from time to time for printhead maintenance. If printhead maintenance is required, the PDB parameters 8408 for the next swath instruct the DMA control 8412 to load the stroke buffers 86 with maintenance print data 8414 rather than print data for the print job from the raster buffers 8404. Once, printhead maintenance is completed, the PDB parameters 8408 instruct the DMA control 8412 to continue loading the stroke buffers 86 with print data for the print job from the next raster buffer 8404.

With reference to FIG. 8, a diagram showing the relationship between linked PDBs (8602, 8604, 8606, 8608) in raster buffers 8404, multiple columns of print data stored in stroke buffers 86, and a single-column array of nozzles in a CMYK printhead 2000 in an embodiment of an ink recorder is provided. This diagram reflects how printing in multiple colors requires segmentation of the printhead and how such segmentation is accommodated in the stroke buffers and raster buffers. This relationship forms the basis by which DMA control 8412 simplifies both the conversion of raster print data 94 in multiple color separations to a column print data stream and the tracking of ink ejections from the nozzles of the printhead 20. As described above, the printhead 2000 is comprised of a single-column array of nozzles with fours segments (2002, 2004, 2006, 2008) of active nozzles and three groups of inactive nozzles (2010, 2012, 2014) between the segments. The four segments are associated with the four color separations in the exemplary CMY-K printhead 2000 For example, a first segment 2002 may be used for printing black ink, a second segment 2004 may be used for printing cyan ink, a third segment 2006 may be used for printing magenta ink, and a fourth segment 2008 may be used for printing yellow ink. Alternate arrangements for the segments are also contemplated.

As described above, the stroke buffer 86 is comprised of a plurality of words represented in a vertical column. Like for the black printhead 20, each word in the stroke buffer 86 is associated with an individual nozzle of the printhead 20 and includes multiple bits that are represented horizontally. However, for the CMYK printhead 20, the stroke buffer 86 is comprised of four PDBs (8602, 8604, 8606, 8608). Each of the PDBs 85 is associated with a different color separation and corresponding segment of the printhead. A first PDB 8602 is defined vertically by the plurality of rows associated with the nozzles in the first segment 2002 of the printhead 2000. Similarly, a second PDB 8604 is defined vertically by the plurality of rows in the stroke buffer 86 associated with the nozzles in the second segment 2004, a third PDB 8606 is defined vertically by the plurality of rows associated with the nozzles in the third segment 2006, and a fourth PDB 8608 is defined vertically by the plurality of rows associated with the nozzles in the fourth segment 2008. Each of the PDBs (8602, 8604, 8606, 8608) are defined horizontally by the plurality of columns related to the multiple bits in the words of the stroke buffer 86.

As described above, for color printing there are at least two raster buffers for each color separation. For an ink recorder having a CMYK printhead 2000, there are four sets of raster buffers 8404. FIG. 8 depicts a first raster buffer from each of the four sets. Each raster buffer 8404 is comprised of multiple rows of horizontal print data that is to be printed during a swath of the printhead 2000 across the recording medium. Each raster buffer 8404 is defined vertically by the PDB for the color separation with which it is associated and horizontally by the length of the swath of print data to be printed.

Since the embodiment being described prints four colors (i.e., CMYK), the stroke buffer 86 is loaded by four PDBs (8602, 8604, 8606, 8608), one from each color separation raster buffer 8404. Therefore, a first PDB 8602 in a first raster buffer for a first color separation are linked 87 to a second PDB 8604 in a second raster buffer for a second color separation, the second PDB 8604 is linked 87 to a third PDB 8606 in a third raster buffer for a third color separation, and the third PDB 8606 is linked 87 to a fourth PDB 8608 in a fourth raster buffer for a fourth color separation. As shown, each raster buffer 8404 is comprised of six PDBs, although for a minimal length print swath a raster buffer 8404 could be limited to one PDB. The rows of horizontal print data in each raster buffer are contiguous and represented as running from left to right. Therefore, the fourth PDB 8608 is linked 87 to a fifth PDB 8602 in the first raster buffer for the first color separation. Linking continues in the same fashion, which is represented as top-to-bottom and left-to-right along the contiguous print data in the four raster buffers 8404. The leftmost PDB 8602 in the first raster buffer is the initial P)B and the right-most PDB 8608 in the fourth raster buffer is the last PDB associated with the swath of print data to be printed. The links 87 between the PDBs define the sequence in which the PDBs will be printed. However, when printing is performed in both directions the print direction information will determine whether printing actually begins with the left-most PDB or the right-most PDB. Likewise, transfers from the raster buffer 8404 to the stroke buffer 86 will begin from either the left or right, depending on the direction in which the printhead 20 is printing. However, like for printing in one color, when multi-color printing is performed in both directions the device parameters indicating print direction will determine whether printing actually begins with the left-most PDB or the right-most PDB. Likewise, transfers from the raster buffer 8404 to the stroke buffer 86 will begin from either the left or right, depending on the direction in which the printhead 20 is printing.

Alternate types of multi-color printheads are also contemplated, including a CMY printhead, a CMYRGB printhead, and a 6-color printhead with CMY colors and lighter or darker shades of the CMY colors. For multi-color printing, the processor 8402 recognizes that a multi-color printhead is installed and generates PDB parameters that are compatible with the printhead, the stroke buffers, and the raster buffers so that conversion of raster print data 94 to vertical print data 98 by the DMA control 8412 performed in the same manner as described above for a single color (e.g., black) printhead.

Figure 9:
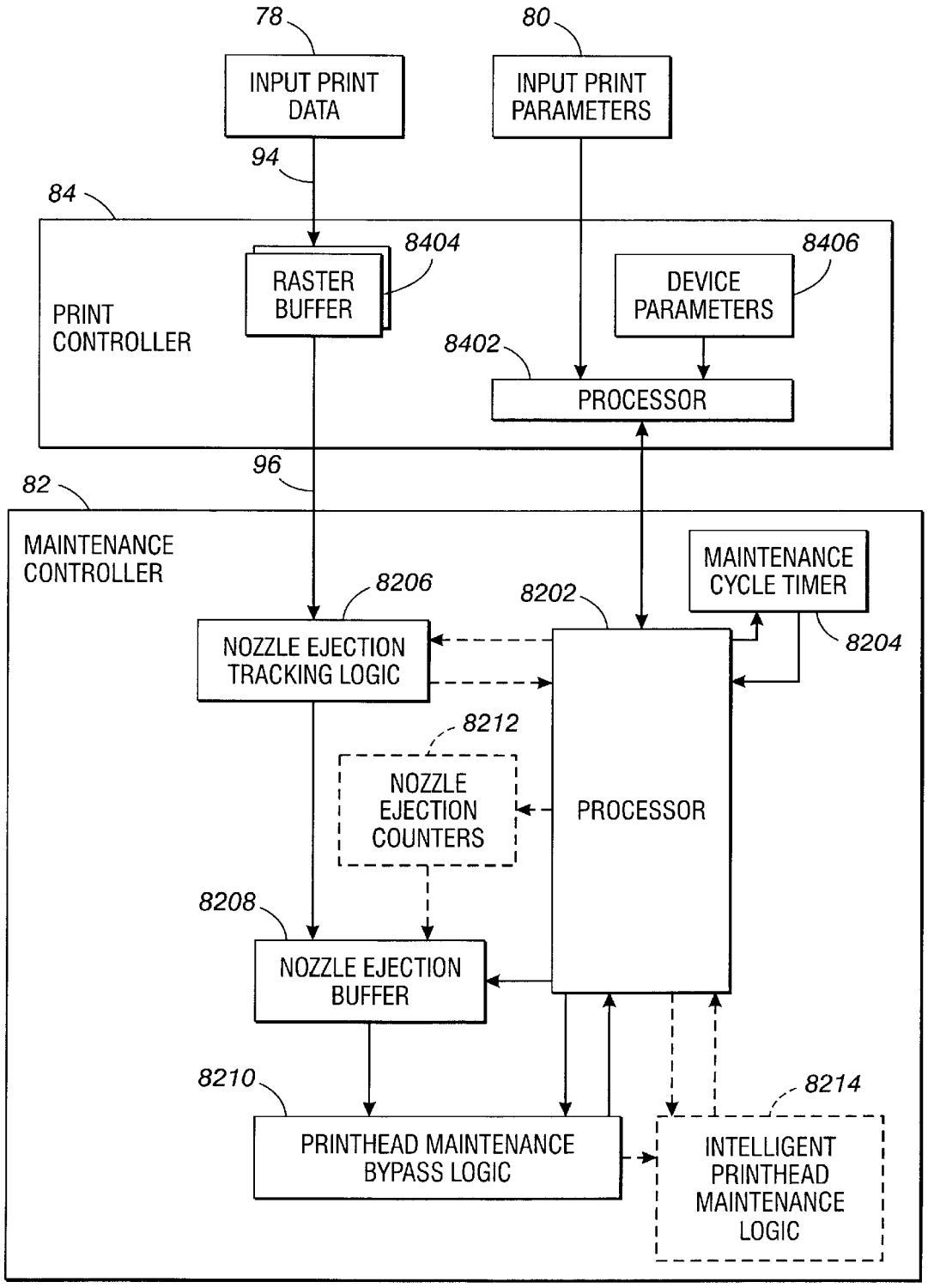
FIG. 9 is a block diagram of an embodiment of a maintenance controller such as the one in FIG. 4.

With reference to FIG. 9, a block diagram of an embodiment of a maintenance controller 82 such as the one in FIG. 4 is provided. The maintenance controller 82 includes a processor 8202, a maintenance cycle timer 8204, nozzle ejection tracking logic 8206, a nozzle ejection buffer 8208, and printhead maintenance bypass logic 8210. Interfaces between the components of the maintenance controller 82 and components of the print controller 84, as well as interfaces and intermediate components (i.e., processor 8402, raster buffers 8404) between input print data 78, input print parameters 80, and device parameters 8406 and the maintenance controller 82, are also shown for clarity. In another embodiment, the maintenance controller 82 may also include nozzle ejection counters 8212. In still another embodiment, the maintenance controller 82 may also include intelligent printhead maintenance logic 8214. In yet another embodiment, the maintenance controller 82 may include both of these options. It is understood that the maintenance controller 82 may include other components not shown in the block diagram.

The processor 8202 receives control signals associated with the input print parameters 80 (i.e., print instructions) and device parameters 8406 from the processor 8402 in the print controller 80. The parameters, for example, include certain performance modes that determine black or color printing, print quality, overall printing speed and information related to printhead identity, print resolutions, multi-pass print modes, printhead segmentation and inactive nozzle positions, printhead maintenance cycle times, and quantities of ink ejections required during the maintenance cycle to bypass maintenance.

The processor 8202 in the maintenance controller 82 controls the printhead maintenance functions of the ink recorder 10 during a print job in terms of timed maintenance cycles. The processor 8202 initializes the maintenance cycle timer 8204 at the start of a print job. The periodic interval for printhead maintenance may be preset in the maintenance cycle timer 8204 or determined by the processor 8202 based on the input print parameters 80 and device parameters 8406 communicated by the processor 8404 in the print controller 84. At the beginning of each maintenance cycle, the processor 8202 resets the nozzle ejection buffer 8208. In the various embodiments described below, the processor also resets the nozzle ejection counters 8212 at the beginning of each maintenance cycle. The processor may also reset the nozzle ejection tracking logic 8206 and the printhead maintenance bypass logic 8210. The processor may also reset the intelligent maintenance bypass logic 8214 in the various embodiments described below.

The nozzle ejection tracking logic 8206 has access to the DMA channel 96, detects when a stroke buffer 86 is addressed for loading print data, and reads the print data as it is being loaded into the stroke buffers 86. Since the print data in the stroke buffers 86 is arranged in as a vertical column of words to be stored in the stroke buffer 86, the nozzle ejection tracking logic 8206 is adapted to read each word and determine if any bit in the word is at a logic level that would direct the associated nozzle in the printhead to eject ink. In one embodiment, the nozzle ejection tracking logic 8206 may be comprised of a logic circuit and a tracking circuit, wherein the logic circuit determines whether any bits in the word are associated with nozzle ejection and the tracking circuit correlates the word to its position in the stroke buffer 86 and the corresponding nozzle in the printhead 20 associated with the word. In another embodiment, the nozzle ejection tracking logic 8206 may be comprised of a plurality of logic circuits, one circuit for each word in the stroke buffer 86. In still another embodiment, the nozzle ejection tracking logic 8206 may be comprised of a plurality of logic circuits, each logic circuit for a predetermined group of words, and a tracking circuit.

The nozzle ejection tracking logic 8206 communicates the resulting nozzle ejection information to the nozzle ejection buffer 8208. The nozzle ejection buffer 8208 stores nozzle ejection information for each nozzle of the printhead 20 during the maintenance cycle. When the nozzle ejection information first indicates that a given nozzle has ejected ink, a corresponding bit in the nozzle ejection buffer 8208 is set. Once a bit in the nozzle ejection buffer 8208 is set, it is not reset until the next maintenance cycle is started. In the embodiment being described, it is understood that the maintenance controller 82 tracks one ink ejection per nozzle. The interval for periodic maintenance established by the maintenance cycle timer 8204 is therefore associated with a minimum of one ink ejection per nozzle.

The nozzle ejection information in the nozzle ejection buffer 8206 is accessible by the printhead maintenance bypass logic 8210. The printhead maintenance bypass logic 8210 determines whether all the nozzles in the printhead 20 have ejected ink during the current maintenance cycle. In one embodiment, as soon as all the bits in the nozzle ejection buffer 8208 that are associated with nozzles indicate that all the nozzles have ejected ink, the printhead maintenance bypass logic 8210 communicates maintenance bypass information to the processor 8202 indicating that maintenance may be bypassed for the current maintenance cycle. In this embodiment, processor 8202 may store the maintenance bypass information and disable the nozzle ejection tracking logic 8206, nozzle ejection buffer 8206, and printhead maintenance bypass logic 8210 for the remainder of the maintenance cycle. If the processor 8202 does not receive maintenance bypass information from the printhead maintenance bypass logic 8210, the processor 8202 may assume that printhead maintenance is required for the current maintenance cycle.

In an alternate embodiment, the processor 8202 may read the maintenance bypass information from the printhead maintenance bypass logic 8210 when the current maintenance cycle ends. In still another embodiment, the processor 8202 may communicate a signal indicating the end of the maintenance cycle to the printhead maintenance bypass logic 8210 or a signal requesting maintenance bypass information. In response, the printhead maintenance bypass logic 8210 communicates the maintenance bypass information. Similarly, maintenance bypass information may be communicated between the processors 8202, 8402 of the maintenance controller 82 and print controller 84 as soon as it is received, at the end of the maintenance cycle, or upon request (e.g., between print swaths). Based on the maintenance bypass information, the print controller 84 either directs a period printhead maintenance procedure to be performed between print swaths or bypasses printhead maintenance and continues with the print job.

In the embodiment being described, printhead maintenance is performed on all nozzles of the printhead. In another embodiment with a segmented printhead (e.g., 2000), the maintenance controller 82 takes into account inactive nozzles between the segments that never eject ink, otherwise printhead maintenance would never be bypassed. Typically, the processor 8202 uses the device parameters 8406 associated with printhead segmentation and inactive nozzle positions to set the corresponding bits in the nozzle ejection buffers 8208 at the start of each maintenance cycle when the bits for active nozzle positions are reset. Alternate arrangements for ignoring the behavior of the inactive nozzles in the maintenance controller 82 are also contemplated. For example, the nozzle ejection tracking logic 8206 or printhead maintenance bypass logic 8210 may be adapted so that it does not care about the condition of the inactive nozzles.

In another embodiment of the maintenance controller 82, bypassing printhead maintenance may be based on multiple ink ejections by each nozzle during the maintenance cycle rather than a single ejection. In this embodiment, the maintenance controller 82 includes nozzle ejection counters 8212. There is one nozzle ejection counter for each nozzle of the printhead 20. The nozzle ejection tracking logic 8206 performs as described above. However, the resulting nozzle ejection information is communicated to the processor 8202. The processor 8202 increments the appropriate nozzle ejection counter 8212 based on the nozzle ejection information to accumulate the number of times each nozzle has ejected ink during the current maintenance cycle. The nozzle ejection counters 8212 communicate the nozzle ejection count information to the nozzle ejection buffer 8208. The nozzle ejection buffer 8208 and printhead maintenance bypass logic 8210 operate as described above. However, in the embodiment being described, the quantity of ink ejections required during the maintenance cycle to bypass maintenance is either preset in the printhead maintenance bypass logic 82 10 or communicated by the processor 8402 in the print controller 84. The interval for periodic maintenance established by the maintenance cycle timer 8204 is associated with the quantity of ink ejections required.

In another embodiment, if multiple types of inks with characteristics that require different quantities of ink ejections and/or different maintenance cycle times are used in the printhead (e.g., 2000), the maintenance controller 82 may include multiple maintenance cycle timers 8204 and multiple printhead maintenance bypass logics 8210. The maintenance controller 82 and print controller 84 may handle printhead maintenance and associated bypass actions for the different inks and corresponding segments of the printhead independently.

In yet another embodiment of the maintenance controller 82, when printhead maintenance is required, the nozzles requiring printhead maintenance during that particular periodic maintenance cycle may be reduced. In this embodiment, the maintenance controller 82 includes intelligent printhead maintenance logic 8214. The nozzle ejection tracking logic 8206, nozzle ejection buffer 8208, and printhead maintenance bypass logic 8210 perform as described above. However, the nozzle ejection information from the nozzle ejection buffer 8208 is also provided to the intelligent printhead maintenance logic 8214. The nozzle ejection information may be relayed by the printhead maintenance bypass logic 8210 or accessed from the nozzle ejection buffer 8208. The intelligent printhead maintenance logic 8214 identifies individual nozzles or groups of nozzles for which maintenance may be bypassed. For multi-color printing the groups of nozzles, may be associated with segmentation of the printhead.

Like the maintenance bypass information from the printhead maintenance bypass logic 8210, the intelligent maintenance bypass information may be communicated to the processor 8202 as soon as a bypass action is recognized, at the end of the maintenance cycle, or upon request. Like the printhead maintenance bypass logic 8210, the intelligent printhead maintenance logic 8214 may be adapted so that it does not care about the condition of the inactive nozzles and may be used in conjunction with the nozzle ejection counters 8212 to bypass printhead maintenance after a predetermined number of ink ejections.

Figure 10:
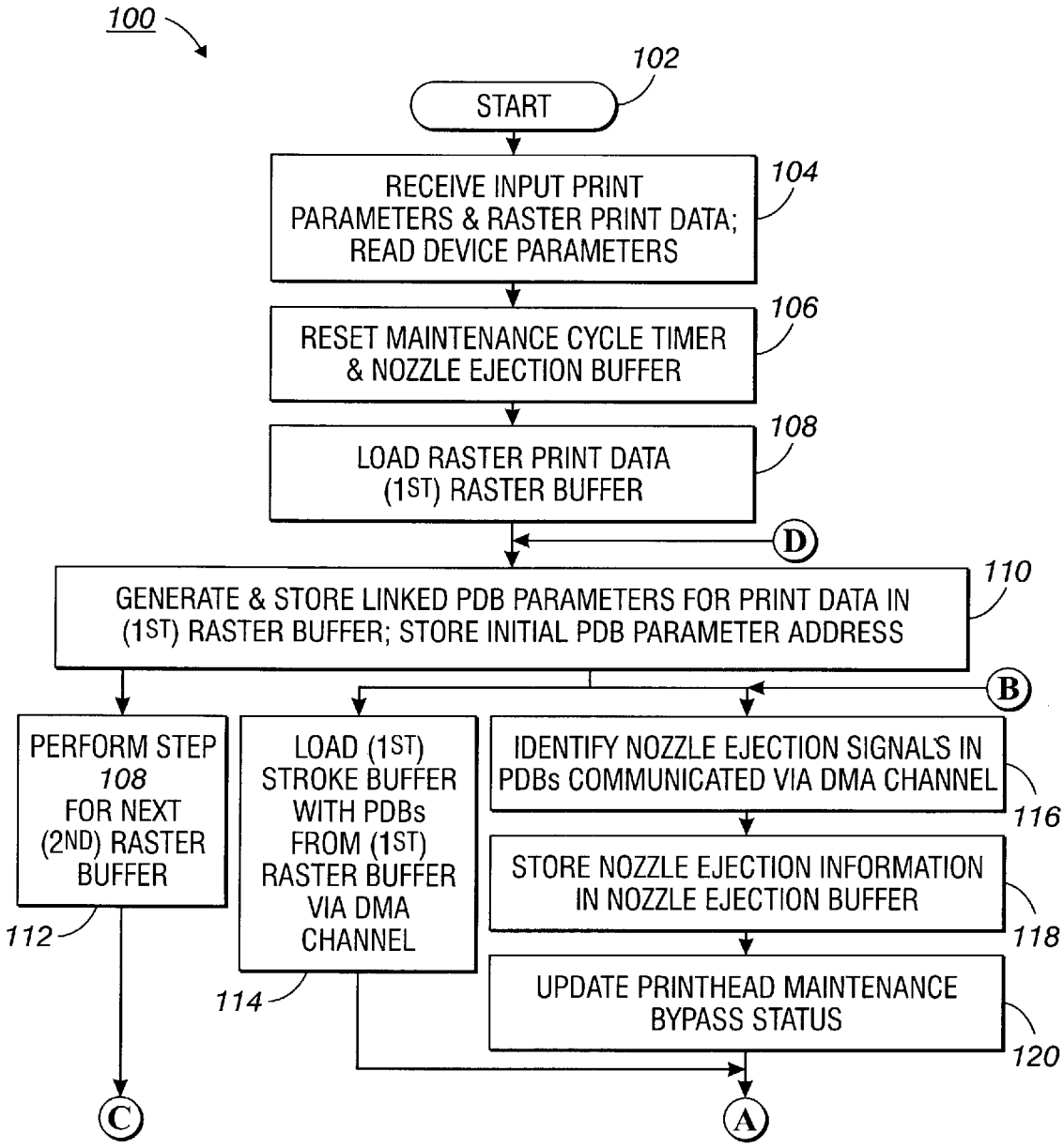
FIGS. 10 and 11 are a flowchart illustrating an embodiment of a method for controlling printhead maintenance in an ink recorder during a print job.
Figure 11:
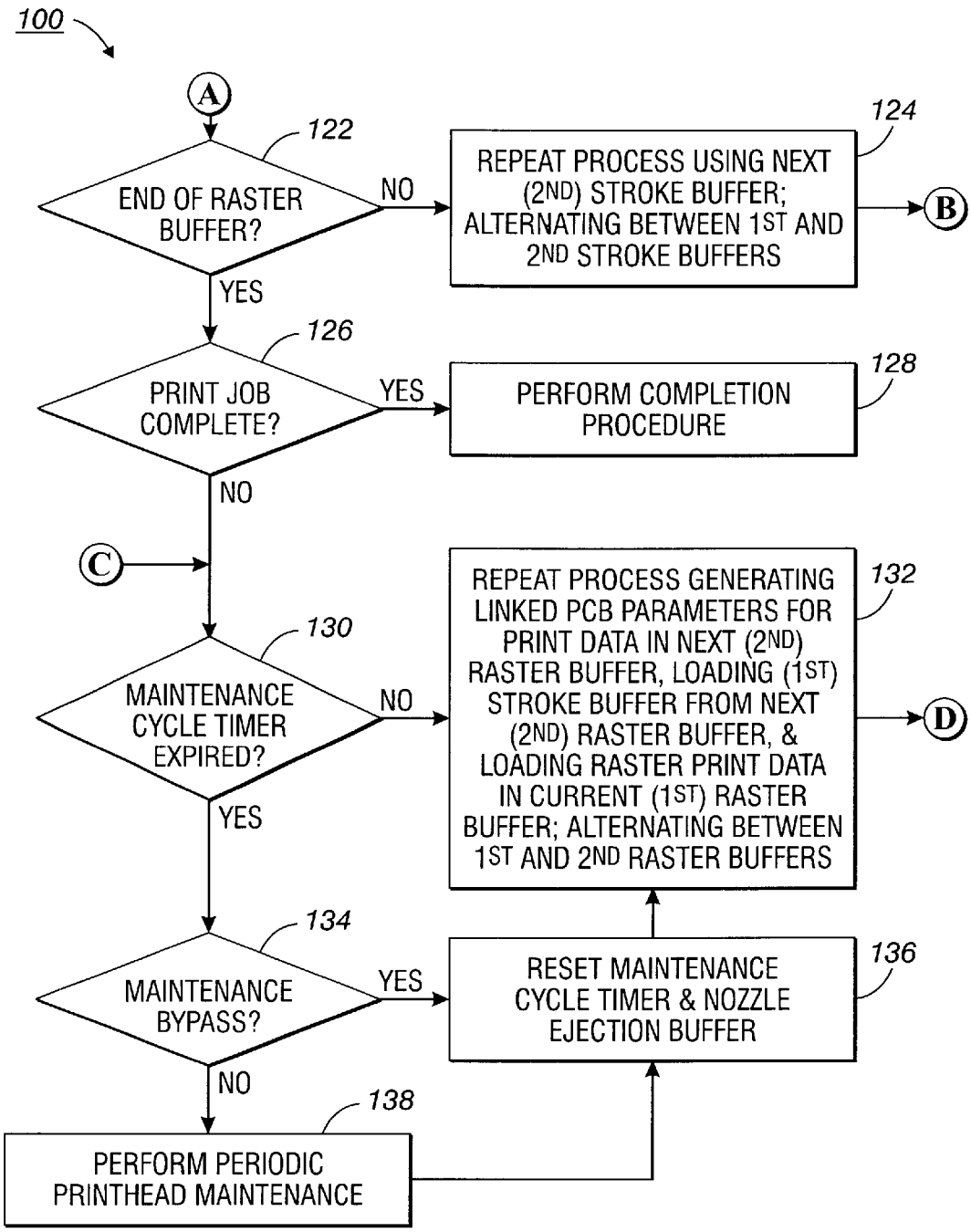

With reference to FIGS. 10 and 11, a flowchart illustrating an embodiment of a method 100 for controlling printhead maintenance in an ink recorder during a print job is provided. The method 100 begins at step 102 when a print job is submitted for printing. At step 104, input print parameters and raster print data are received. Additionally, device parameters are read during step 104. Next, at step 106, a printhead maintenance cycle timer and a nozzle ejection buffer are reset. A first print swath of the raster print data is loaded in a first raster buffer at step 108. Next, at step 110, linked PDB parameters are generated and stored for the print data in the first raster buffer. Additionally, an initial PDB parameter address is stored at step 110.

At this point the method splits into several parallel paths. A first path begins with step 112 where a second print swath of the raster print data is loaded in a second raster buffer. A second path operates using print data from the first raster buffer and is split further into steps 114 and the sequence of steps 116–120. At step 114, a first stroke buffer is loaded with one or more PDBs from the first raster buffer via a DMA channel. Loading of the first stroke buffer begins by reading the initial PDB parameter address, accessing the initial PDB parameter, and loading the initial PDB. If additional PDBs are included in the stroke buffer, a link to the address of a next PDB parameter is included in the current PDB parameter to continue loading the stroke buffer.

At step 116, nozzle ejection signals are identified in the PDBs communicated via the DMA channel. The resulting nozzle ejection information is stored in the nozzle ejection buffer (step 118) and, based on new and accumulated nozzle ejection information, a printhead maintenance bypass status is updated (step 120). Generally, when all the active nozzles in the printhead have ejected ink during the current maintenance cycle, printhead maintenance may be bypassed and the printhead maintenance bypass status is set, otherwise the status indicates that printhead maintenance is required.

At step 122, a sequence of steps begins that determine how the method continues after nozzle ejection information is compiled for the first stroke buffer. First, a check is made to determine whether the end of the raster buffer has been reached (step 122). If the end of the raster buffer has not been reached, the process repeats steps 114–122 using a second stroke buffer (step 124). This forms a nested loop that is repeated, alternating between the first and second stroke buffers, until the end of the raster buffer is reached in step 122. When the end of the raster buffer is reached, a check is made to determine whether the print job is complete (step 126). In other words, whether the current print swath is the last print swath for the print job. If the print job is complete, a print completion procedure is performed (step 128) and the method is ended.

If the print job is not complete, a check is made to determine whether the maintenance cycle timer has expired (step 130). If the maintenance cycle timer has not expired, the process repeats steps 110–130 generating linked PDB parameters for print data in the second raster buffer, loading a first stroke buffer with PDBs from the second raster buffer, and loading raster print data in the first raster buffer (step 132). This forms a nested loop that is repeated, alternating between the first and second raster buffers, until the print job is complete in step 128 or, if the print job is not complete, the maintenance cycle timer has expired in step 130. When the maintenance cycle timer has expired, a check is made to determine whether printhead maintenance may be bypassed (step 134).

If printhead maintenance may be bypassed, the maintenance cycle timer and nozzle ejection buffer are reset (step 136) and step 132 is repeated which in turn loops back to repeat steps 110–130. In other words, the method permits normal processing of the print job to continue without interruption. However, if maintenance cannot be bypassed, periodic printhead maintenance is performed at step 138. Then, the maintenance cycle timer and nozzle ejection buffer are reset (step 136) and step 132 is repeated which in turn loops back to repeat steps 110–130. In other words, the method continues normal processing of the print job after the maintenance procedure is performed.

Figure 12:
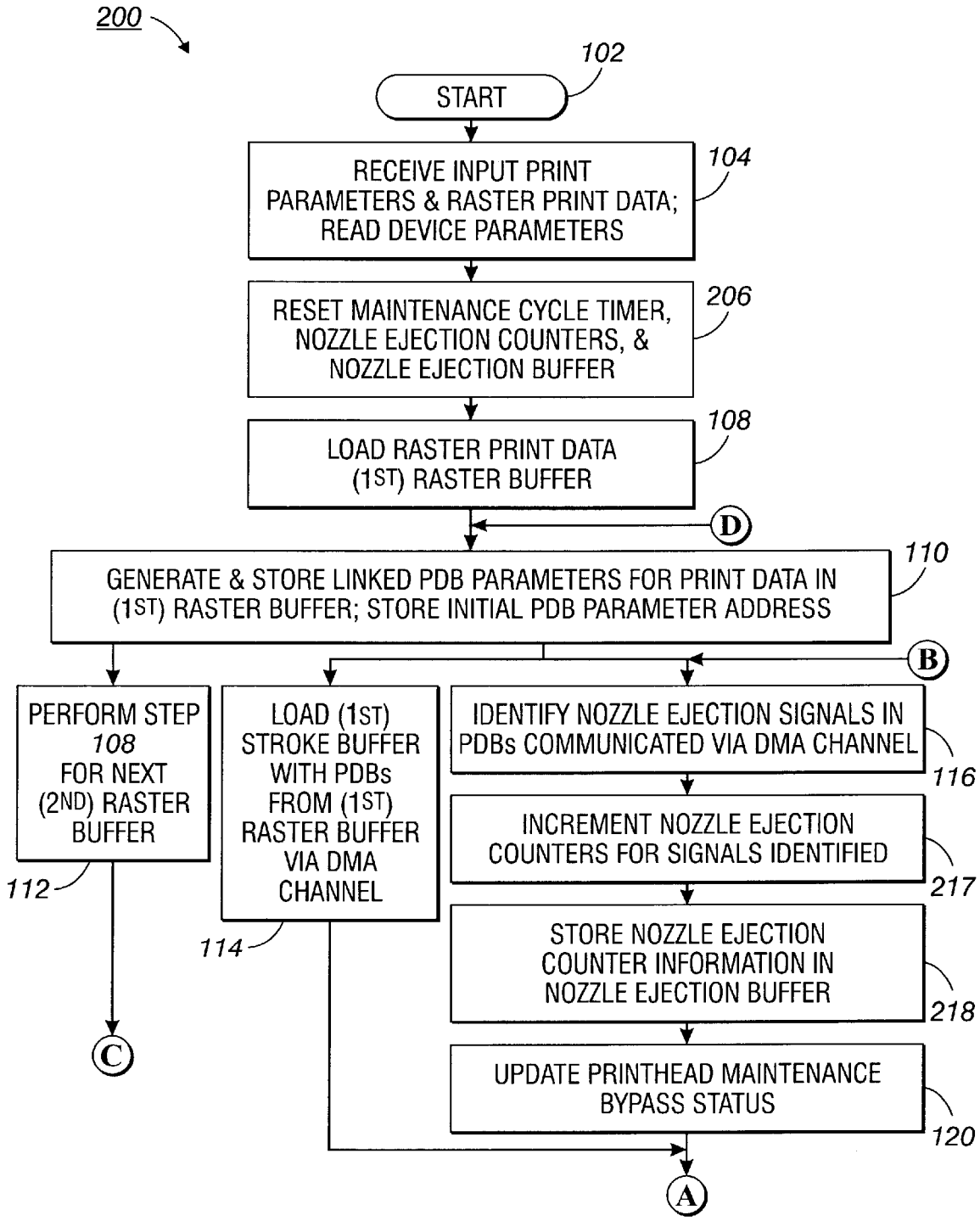
FIGS. 12 and 13 are a flowchart illustrating another embodiment of a method for controlling printhead maintenance in an ink recorder during a print job.
Figure 13:
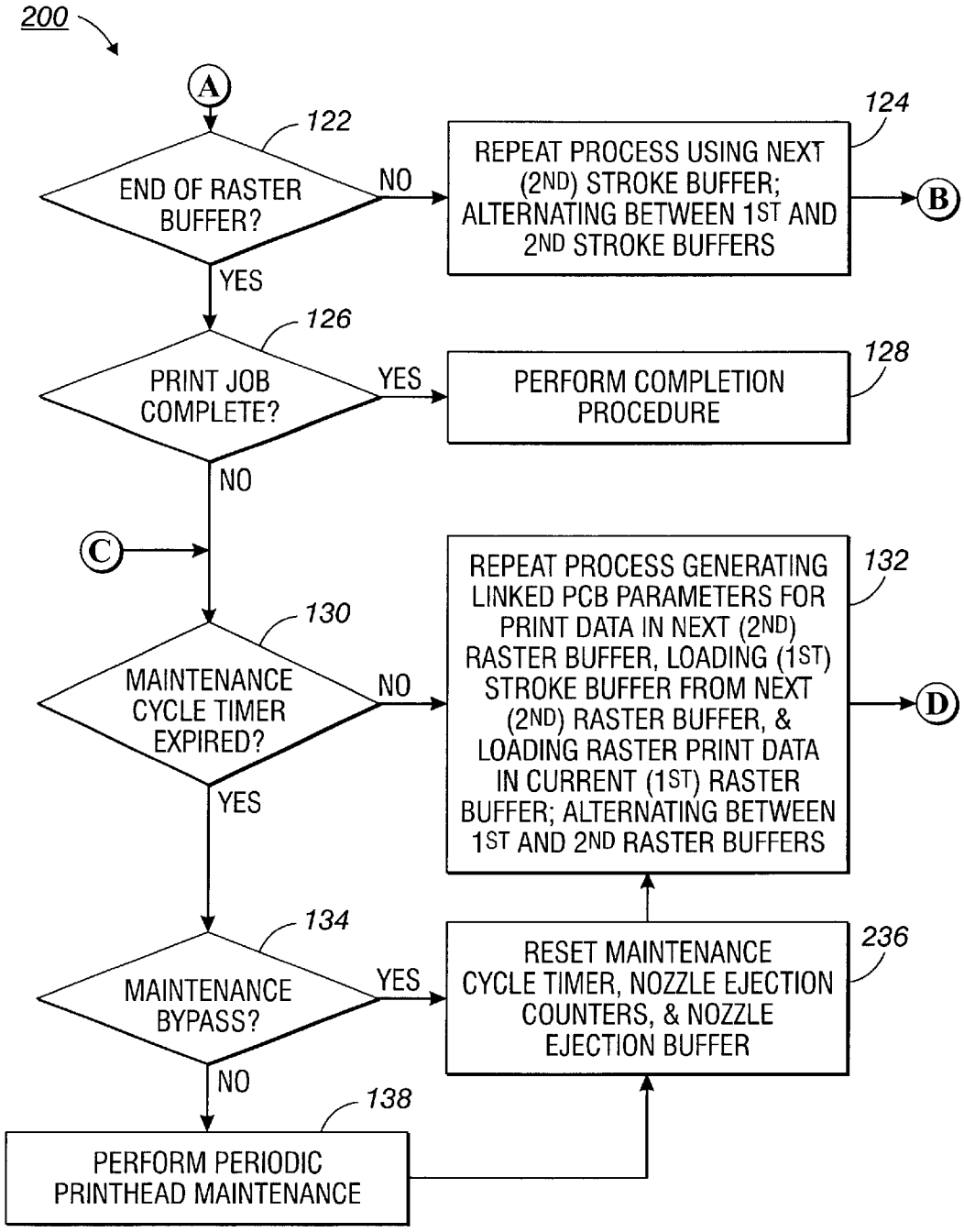

With reference to FIGS. 12 and 13, a flowchart illustrating another embodiment of a method 200 for controlling printhead maintenance in an ink recorder during a print job is provided. Similar to the method 100 described for FIGS. 10 and 11, this method 200 further includes steps that monitor the number of ink ejections by each nozzle during the maintenance cycle and the decision to bypass printhead maintenance is based on a predetermined quantity of ink ejections. The steps that retain the same number used in the method 100 described for FIGS. 10 and 11 function in the same manner and are not repeated in this description. The following paragraphs merely identify new or modified steps in the method being described.

The first modification is at step 206, where a printhead maintenance cycle timer, nozzle ejection counters, and a nozzle ejection buffer are reset. After step 206, the next area that is different from the method 100 described in FIGS. 10 and 11 begins after step 116. The nozzle ejection information resulting from step 116 is used to increment the nozzle ejection counters (step 217). The nozzle ejection count information is stored in the nozzle ejection buffer (step 218) and, based on new and accumulated nozzle ejection count information, a printhead maintenance bypass status is updated (step 120). Generally, when all the active nozzles in the printhead have made a predetermined quantity of ink ejections during the current maintenance cycle, printhead maintenance may be bypassed and the printhead maintenance bypass status is set, otherwise the status indicates that printhead maintenance is required.

Figure 14:
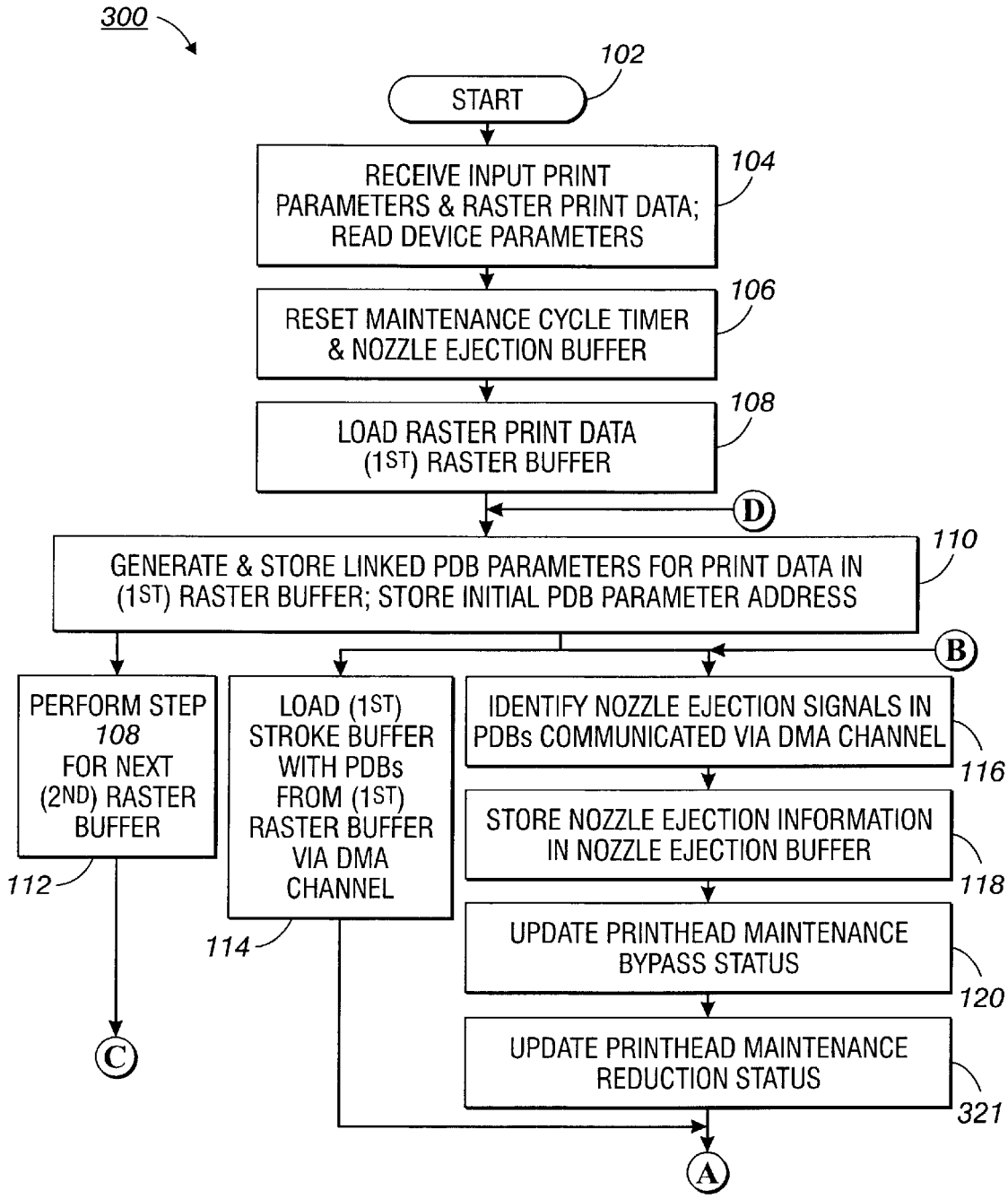
FIGS. 14–16 are a flowchart illustrating yet another embodiment of a method for controlling printhead maintenance in an ink recorder during a print job.
Figure 15:
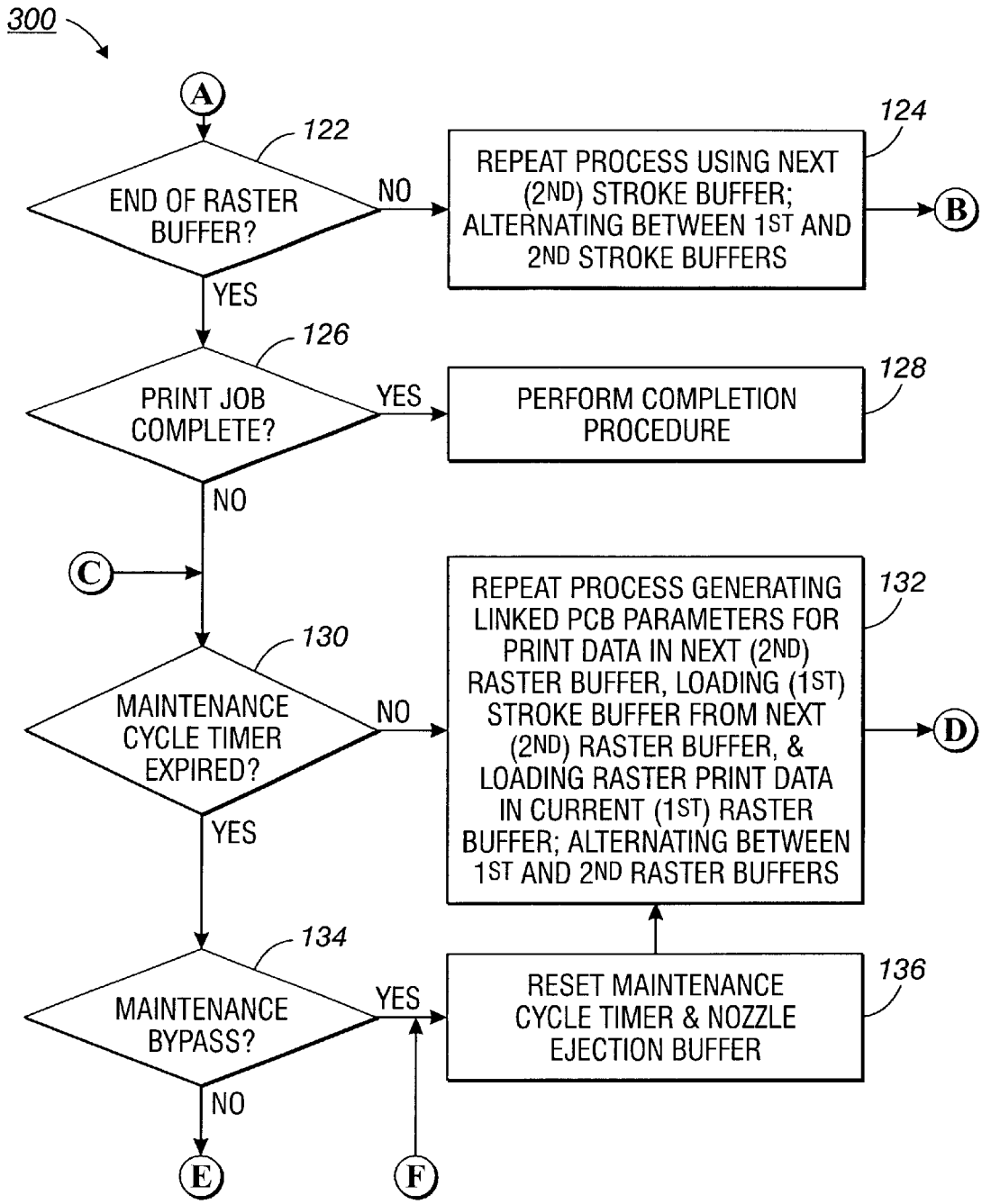
Figure 16:
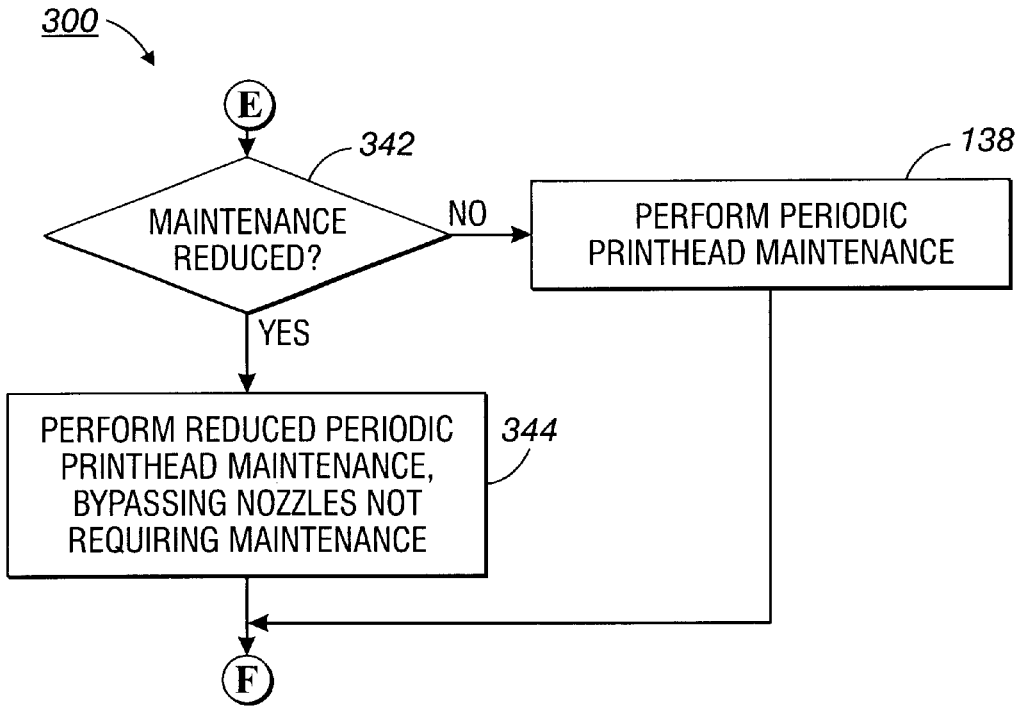

With reference to FIGS. 14–16, a flowchart illustrating yet another embodiment of a method 300 for controlling printhead maintenance in an ink recorder during a print job is provided. Similar to the method 100 described for FIGS. 10 and 11, this method 300 further includes steps that track the status of ink ejection combinations associated with printhead maintenance reductions and, when maintenance cannot be completely bypassed, determine whether printhead maintenance may be reduced. The steps that retain the same number used in the method 100 described for FIGS. 10 and 11 function in the same manner and are not repeated in this description. The following paragraphs merely identify new or modified steps in the method being described.

The first new step is step 321, where the new and accumulated nozzle ejection information is used to update a printhead maintenance reduction status. Generally, when all the active nozzles in the printhead have ejected ink during the current maintenance cycle, printhead maintenance may be bypassed and the printhead maintenance bypass status is set, otherwise the status indicates that printhead maintenance is required. In this embodiment, even though printhead maintenance is required, maintenance may be reduced because maintenance is not required for individual nozzles that have ejected ink during the current maintenance cycle. In another embodiment, even though printhead maintenance is required, maintenance may be reduced by groups or segments of nozzles if each nozzle in the group or segment ejected ink during the current maintenance cycle.

After step 321, the next area that is different from the method 100 described in FIGS. 10 and 11 begins after step 134. If printhead maintenance cannot be bypassed in step 134, a check is made to determine whether printhead maintenance may be reduced (step 342). If printhead maintenance may be reduced, a reduced form of periodic printhead maintenance is performed at step 344 for the current maintenance cycle based on the current printhead maintenance reduction status from step 321. Then, the maintenance cycle timer and nozzle ejection buffer are reset (step 136) and step 132 is repeated which in turn loops back to repeat steps 110–130 (including new step 321). In other words, the method continues normal processing of the print job after the reduced maintenance procedure is performed.

If periodic maintenance cannot be reduced, periodic printhead maintenance is performed at step 138. Then, the maintenance cycle timer and nozzle ejection buffer are reset (step 136) and step 132 is repeated which in turn loops back to repeat steps 110–130 (including new step 321). In other words, the method continues normal processing of the print job after the full maintenance procedure is performed.

In another embodiment of a method for controlling printhead maintenance in an ink recorder during a print job, the optional features of FIGS. 12–16 can be combined. In this embodiment, the required quantity of ink ejections can be varied for groups or segments of nozzles or for individual nozzles. Typically, the quantity of ink ejections required is based on the type of ink being ejected. Therefore, where the printhead ejects multiple types of ink with different characteristics, it may be practical to implement this combination in order to control printhead maintenance for the different types of ink independently.

It is to be appreciated that while the forgoing has been described in connection with printing of ink, it may be used in other ejection applications such as biological fluids, medicines, metals, etc. Moreover, while the invention is described herein in conjunction with exemplary embodiments, it is evident that many alternatives, modifications, and variations will be apparent to those skilled in the art. Accordingly, the embodiments of the invention in the preceding description are intended to be illustrative, rather than limiting, of the spirit and scope of the invention. More specifically, it is intended that the invention embrace all alternatives, modifications, and variations of the exemplary embodiments described herein that fall within the spirit and scope of the appended claims or the equivalents thereof.

What is claimed is:

1. An ink recorder for receiving raster print data and printing an image on a recording medium corresponding to the raster print data received, comprising:

a printhead with a plurality of ink ejecting nozzles, wherein the plurality of the ink ejecting nozzles include a plurality of active nozzles;

a print controller for controlling conversion of the raster print data to a print data stream and for controlling printhead maintenance procedures, the print controller further comprising:

raster buffers adapted to receive and store a predetermined amount of the raster print data, wherein the raster print data stored in the raster buffers is divided into a linked sequence of print data blocks of a predetermined size;

stroke buffers adapted to receive and store at least one print data block from the raster buffers;

a DMA channel interconnecting the raster buffers and the stroke buffers for communicating the print data blocks from the raster buffer to the stroke buffers;

a print engine in communication with the stroke buffers and the printhead, wherein the print engine receives multiple strings of print data from the stroke buffers, wherein the print engine forms the print data stream from the multiple strings of print data and communicates the print data stream to the printhead; and a maintenance controller in communication with the DMA channel and the print controller, wherein the maintenance controller monitors the DMA channel for the print data blocks communicated from the raster buffers to the stroke buffers, wherein the maintenance controller establishes a timed maintenance cycle, determines whether each of the active nozzles in the printhead ejected ink during the maintenance cycle from the print data in the print data blocks, and communicates maintenance bypass information to the print controller.

2. The ink recorder of claim 1, the maintenance controller further including:

a nozzle ejection tracking logic module in communication with the DMA channel, wherein the nozzle ejection tracking logic module is adapted to (i) read individual words within the print data blocks communicated from the raster buffers to the stroke buffers, (ii) determine if any bit in each individual word would direct a nozzle in the printhead to eject ink, (iii) recognize the nozzle with which each word is associated, and (iv) generate nozzle ejection information indicating the result of each determination and the nozzle associated with each result.

3. The ink recorder of claim 2, the maintenance controller further including:

a nozzle ejection buffer with a plurality of bits, wherein each bit is associated with a nozzle in the printhead, wherein the maintenance controller resets the nozzle ejection buffer during a beginning portion of each timed maintenance cycle, wherein the nozzle ejection buffer is in communication with the nozzle ejection tracking module and receives the nozzle ejection information generated thereby, wherein, when the nozzle ejection information indicates that one or more nozzles in the printhead will be directed to eject ink, the bits in the nozzle ejection buffer corresponding to the one or more nozzles are set and remain set during the current maintenance cycle.

4. The ink recorder of claim 3, the maintenance controller further including:

a printhead maintenance bypass logic module with access to the nozzle ejection information stored in the nozzle ejection buffer, wherein the printhead maintenance bypass logic module is adapted to determine whether all the active nozzles in the printhead have been or will be directed to eject ink and generate maintenance bypass information associated therewith.

5. The ink recorder of claim 4, the maintenance controller further including:

an intelligent printhead maintenance logic module with access to the nozzle ejection information stored in the nozzle ejection buffer, wherein the intelligent printhead maintenance logic module is adapted to determine whether individual active nozzles in the printhead have been or will be directed to eject ink and generate intelligent maintenance bypass information associated therewith; and wherein the maintenance controller communicates the intelligent maintenance bypass information to the print controller.

6. The ink recorder of claim 2, the nozzle ejection tracking logic module further including:

a logic circuit for determining if any bit in each individual word would direct a nozzle in the printhead to eject ink; and a tracking circuit to recognize the nozzle with which each word is associated.

7. The ink recorder of claim 2, the nozzle ejection tracking logic module further including:

a plurality of logic circuits, wherein each logic circuit is associated with a unique word in the print data block, wherein each logic circuit determines if any bit in the associated word would direct a nozzle in the printhead to eject ink and recognizes the nozzle with which the associated word is associated.

8. The ink recorder of claim 2, the nozzle ejection tracking logic module further including:

a plurality of logic circuits, wherein each logic circuit is associated with a unique group of individual words in the print data block, wherein each logic circuit determines if any bit in each individual word of the associated group word would direct a nozzle in the printhead to eject ink; and a tracking circuit to recognize the nozzle with which each word is associated.

9. The ink recorder of claim 2, the maintenance controller further including:

a plurality of nozzle ejection counter processes, wherein each counter process is associated with a nozzle in the printhead, wherein the maintenance controller, resets the nozzle ejection counter processes during a beginning portion of each timed maintenance cycle, wherein the nozzle ejection counter processes are in communication with the nozzle ejection tracking module and receive the nozzle ejection information generated thereby, wherein, each time the nozzle ejection information indicates that a nozzle in the printhead will be directed to eject ink, the counter process corresponding to that nozzle is incremented to generate nozzle ejection count information for each nozzle during the current maintenance cycle.

10. The ink recorder of claim 9, the maintenance controller further including:

a nozzle ejection buffer with a plurality of bits, wherein each bit is associated with a nozzle in the printhead, wherein the maintenance controller resets the nozzle ejection buffer during a beginning portion of each timed maintenance cycle, wherein the nozzle ejection buffer is in communication with the nozzle ejection counter processes and receives and stores the nozzle ejection count information generated thereby.

11. The ink recorder of claim 10, the maintenance controller further including:

a printhead maintenance bypass logic module with access to the nozzle ejection count information stored in the nozzle ejection buffer, wherein the printhead maintenance bypass logic module is adapted to determine whether all the active nozzles in the printhead have been or will be directed to eject ink a predetermined number of times and generate maintenance bypass information associated therewith.

12. The ink recorder of claim 1, wherein the ink recorder is for printing an image using a plurality of color inks, and:

wherein the column of ink ejecting nozzles in the printhead includes a segment of active nozzles associated with each color ink and one or more inactive nozzles between each adjacent segment;

wherein the raster buffers in the print controller form a first ordered pair of raster buffers associated with a first color ink, wherein the ordering of the ordered pair is related to the alternating fashion in which the raster buffers receive raster print data for an odd-numbered pass and an even-numbered pass of the printhead across the recording medium;

the print controller further including additional ordered pairs of raster buffers for each additional color ink, wherein each ordered pair is associated with a segment of active nozzles in the printhead that is commonly associated with the same color ink as the ordered pair;

wherein the raster print data stored in each raster buffer is divided into print data blocks of a predetermined size along a length of the raster buffer, wherein the print data blocks in raster buffers associated with the odd-numbered pass of the printhead are: i) linked to form a sequence of print data blocks in a raster buffer-to-raster buffer fashion related to the sequence of segments in the printhead such that the sequence is based on commonly associated colors of the raster buffers and the segments and then ii) linked to form a sequence of consecutive sequences along the length of the raster buffers such that a last print control block in each sequence is linked to a first control block in a next sequence, wherein the print data blocks in raster buffers associated with an even-numbered pass of the printhead are independently linked in the same fashion; and wherein each stroke buffer is adapted to receive and store the linked print data blocks associated with a sequence from the raster buffers.

13. The ink recorder of claim 12, the maintenance controller further including:

a nozzle ejection tracking logic module in communication with the DMA channel, wherein the nozzle ejection tracking logic module is adapted to read individual words within the print data blocks communicated from the raster buffers to the stroke buffers, determine if any bit in each individual word would direct a nozzle in the printhead to eject ink, recognize the nozzle with which each word is associated, and generate nozzle ejection information indicating the result of each determination and the nozzle associated with each result;

a nozzle ejection buffer with a plurality of bits, wherein each bit is associated with a nozzle in the printhead, wherein the maintenance controller resets the nozzle ejection buffer during a beginning portion of each timed maintenance cycle, wherein the nozzle ejection buffer is in communication with the nozzle ejection tracking module and receives the nozzle ejection information generated thereby, wherein, when the nozzle ejection information indicates that one or more nozzles in the printhead will be directed to eject ink, the bits in the nozzle ejection buffer corresponding to the one or more nozzles are set and remain set during the current maintenance cycle;

a printhead maintenance bypass logic module with access to the nozzle ejection information stored in nozzle ejection buffer, wherein the printhead maintenance bypass logic module is adapted to determine whether all the active nozzles in the printhead have been or will be directed to eject ink and generate maintenance bypass information associated therewith; and an intelligent printhead maintenance logic module with access to the nozzle ejection information stored in nozzle ejection buffer, wherein the intelligent printhead maintenance logic module is adapted to determine whether all active nozzles in each segment of the printhead have been or will be directed to eject ink and generate intelligent maintenance bypass information associated therewith; and wherein the maintenance controller communicates the intelligent maintenance bypass information to the print controller.

14. The ink recorder of claim 1, wherein the ink recorder is adapted to operate in an electrophotographic printing system.

15. A method of ink ejection tracking for controlling printhead nozzle maintenance of a printhead in an ink recorder during a print job, wherein the printhead includes a plurality of ink ejecting nozzles arranged in a single column, comprising the following steps:

a) receiving input print parameters and raster print data associated with an image to be printed;

b) resetting a maintenance cycle timer and a nozzle ejection buffer;

c) loading a first print swath of raster print data in a first raster buffer;

d) generating and storing linked print data block parameters associated with the raster print data in the first raster buffer;

e) loading a second print swath of raster print data in a second raster buffer;

f) loading a first stroke buffer with a first print data block from the first raster buffer via a DMA channel;

g) identifying nozzle ejection signals in the first print data block communicated via the DMA channel to generate nozzle ejection information;

h) storing new and accumulated nozzle ejection information in the nozzle ejection buffer;

i) updating a printhead maintenance bypass status based on the stored nozzle ejection information;

j) repeating steps f)–i) until the last print data block in the first raster buffer is loaded in a stroke buffer, first using a second stroke buffer, then alternating between the first and second stroke buffers;

k) if the print job is complete, performing a completion procedure, otherwise, repeating steps d)–j) until the maintenance cycle timer expires, first generating print data block parameters for the raster print data in the second raster buffer, then alternating between the first and second raster buffers;

l) after the maintenance cycle timer expires, determining the condition of the printhead maintenance bypass status to check if printhead maintenance may be bypassed; and m) if printhead maintenance may be bypassed, resetting the maintenance cycle timer and the nozzle ejection buffer and repeating steps d)–l), otherwise, performing periodic printhead maintenance, resetting the maintenance cycle timer and the nozzle ejection buffer, and repeating steps d)–l).

16. The method of claim 15, further including the following steps:

n) in step b), resetting a nozzle ejection counter along with the maintenance cycle timer and the nozzle ejection buffer;

o) between steps g) and h), incrementing nozzle ejection counters based on the nozzle ejection information to generate nozzle ejection count information;

p) in step h), storing the nozzle ejection count information in the nozzle ejection buffer instead of the nozzle ejection information, q) in step i), updating the printhead maintenance bypass information based on the nozzle ejection count information instead of the nozzle ejection information; and r) in step m), resetting the nozzle ejection counter along with the maintenance cycle timer and the nozzle ejection buffer.

17. The method of claim 15, further including the following steps:

n) between steps i) and j), updating a printhead maintenance reduction status based on the stored nozzle ejection information; and o) in step m), if printhead maintenance cannot be bypassed, before performing periodic printhead maintenance, determining the condition of the printhead maintenance reduction status to check if printhead maintenance may be reduced and, if printhead maintenance may be reduced, performing a reduced form of periodic printhead maintenance based on the current printhead maintenance reduction status by bypassing nozzles in the printhead not requiring maintenance.

18. A method of ink ejection tracking for controlling printhead nozzle maintenance of a printhead during a print job in an ink recorder that prints an image using a plurality of color inks, wherein the printhead includes a plurality of ink ejecting nozzles arranged in a single column, wherein the single column of nozzles in the printhead includes a segment of active nozzles associated with each color ink and one or more inactive nozzles between each adjacent segment, comprising the following steps:

a) receiving input print parameters and raster print data associated with an image to be printed, b) resetting a maintenance cycle timer and a nozzle ejection buffer;

c) loading a first print swath of raster print data in a first raster buffer associated with a first color ink and a third raster buffer associated with a second color ink;

d) generating and storing linked print data block parameters associated with the raster print data in the first raster buffer and the third raster buffer;

e) loading a second print swath of raster print data in a second raster buffer associated with the first color ink and a fourth raster buffer associated with the second color ink;

f) loading a first stroke buffer with a first print data block from the first raster buffer and a first print data block from the third raster buffer via a DMA channel, g) identifying nozzle ejection signals in the first print data blocks communicated via the DMA channel to generate nozzle ejection information;

h) storing new and accumulated nozzle ejection information in the nozzle ejection buffer;

i) updating a printhead maintenance bypass status based on the stored nozzle ejection information;

j) repeating steps f)–i) until the last print data blocks in the first and third raster buffers are loaded in a stroke buffer, first using a second stroke buffer, then alternating between the first and second stroke buffers;

k) if the print job is complete, performing a completion procedure, otherwise, repeating steps d)–j) until the maintenance cycle timer expires, first generating print data block parameters for the raster print data in the second and fourth raster buffers, then alternating between the first/third raster buffers and the second/fourth raster buffers;

l) after the maintenance cycle timer expires, determining the condition of the printhead maintenance bypass status to check if printhead maintenance may be bypassed; and m) if printhead maintenance may be bypassed, resetting the maintenance cycle timer and the nozzle ejection buffer and repeating steps d)–l), otherwise, performing periodic printhead maintenance, resetting the maintenance cycle timer and the nozzle ejection buffer, and repeating steps d)–l).

19. The method of claim 18, further including the following steps:

n) between steps i) and j), updating a printhead maintenance reduction status based on the stored nozzle ejection information; and o) in step m), if printhead maintenance cannot be bypassed, before performing periodic printhead maintenance, determining the condition of the printhead maintenance reduction status to check if printhead maintenance may be reduced and, if printhead maintenance may be reduced, performing a reduced form of periodic printhead maintenance based on the current printhead maintenance reduction status by bypassing nozzles in the printhead not requiring maintenance.

20. The method of claim 19, further including the following steps:

p) wherein the printhead maintenance bypass status in step i) does not consider nozzle ejection information associated with inactive nozzles of the printhead;

q) wherein the printhead maintenance reduction status in step n) includes status information for each segment of the printhead;

r) wherein the periodic printhead maintenance performed in step m) ejects ink from all active nozzles of the printhead and does not eject ink from any inactive nozzles of the printhead; and s) wherein the reduced form of periodic printhead maintenance performed in step o) bypasses maintenance of the active nozzles in one or more, but not all, segments of the printhead.

21. An ink recorder for receiving raster print data and printing an image on a recording medium corresponding to the raster print data received, comprising:

a printhead with a plurality of ink ejecting nozzles arranged in a single column, wherein the printhead is adapted to receive a vertical print data stream, wherein the printhead is for printing the image in a plurality of vertical passes through the nozzles during a plurality of horizontal passes across the recording medium based on the vertical print data stream, wherein the plurality of the ink ejecting nozzles include a plurality of active nozzles;

a print controller for controlling conversion of the raster print data to the vertical print data stream and for controlling printhead maintenance procedures, the print controller further comprising:

a first and a second raster buffer, each raster buffer adapted to receive and store a predetermined amount of raster print data, wherein the predetermined amount of raster print data is associated with a portion of the image to be printed during a horizontal pass of the printhead, wherein the first raster buffer receives raster print data associated with a first horizontal pass of the printhead and the second raster buffer receives raster print data associated with a second horizontal pass of the printhead, and the raster buffers continue to receive raster print data in an alternating fashion for consecutive horizontal passes of the printhead, wherein the raster print data stored in each raster buffer is divided into a linked sequence of print data blocks of a predeternined size along a horizontal length of that raster buffer;

a first and a second stroke buffer, each stroke buffer adapted to receive and store at least one print data block from a raster buffer, each print data block comprising a vertical column of words, wherein a predetermined vertical dimension of each print data block is associated with a vertical dimension of the single-column of nozzles in the printhead and the predetermined horizontal dimension of the print data block is associated with a quantity of bits in the words of the stroke buffers;

a DMA channel interconnecting the raster buffers and the stroke buffers for communicating the print data blocks from the raster buffer to the stroke buffers;

a print engine in communication with the stroke buffers and the printhead, wherein the print engine receives multiple strings of vertical print data from the stroke buffers, wherein the print engine forms the vertical print data stream from the multiple strings of vertical print data and communicates the vertical print data stream to the printhead; and a maintenance controller in communication with the DMA channel and the print controller, wherein the maintenance controller monitors the DMA channel for the print data blocks communicated from the raster buffers to the stroke buffers, wherein the maintenance controller establishes a timed maintenance cycle, determines whether each of the active nozzles in the printhead ejected ink during the maintenance cycle from the print data in the print data blocks, and communicates maintenance bypass information to the print controller.

22. A method of ink ejection tracking for controlling printhead nozzle maintenance of a printhead in an ink recorder, wherein the printhead includes a plurality of ink ejecting nozzles, the method comprising:

a) loading a first print swath of raster print data in a raster buffer arrangement;

b) generating and storing linked print data block parameters associated with the raster print data in the raster buffer arrangement;

c) loading a stroke buffer arrangement with a first print data block from the raster buffer arrangement via a DMA channel;

d) identifying nozzle ejection signals in the first print data block communicated via the DMA channel to generate nozzle ejection information;

e) storing new and accumulated nozzle ejection information in a nozzle ejection buffer;

f) updating a printhead maintenance bypass status based on the stored nozzle ejection information;

g) repeating steps c)–f) until the last print data block is loaded in the stroke buffer arrangement;

h) if the print job is complete, performing a completion procedure, otherwise, repeating steps b)–g) until the maintenance cycle timer expires;

i) after the maintenance cycle timer expires, determining the condition of the printhead maintenance bypass status to check if printhead maintenance may be bypassed; and j) if printhead maintenance may be bypassed, resetting the maintenance cycle timer and the nozzle ejection buffer and repeating steps b)–i).

* * * * *